US010429144B2

(12) United States Patent
Cudazzo

(10) Patent No.: US 10,429,144 B2
(45) Date of Patent: Oct. 1, 2019

(54) AUTOMATIC SUBMACHINE GUN FOR EXPLOITING RECOIL COMPRISING TWO OPPOSING LEVERS FOR THE HAMMER, ONE ASSOCIATED WITH SINGLE-SHOT FIRING MODE AND THE OTHER WITH BURST FIRING MODE

(71) Applicant: Far League S.R.L., Milan (IT)

(72) Inventor: Antonio Cudazzo, Milan (IT)

(73) Assignee: Far League S.R.L., Milan (IT)

( * ) Notice: Subject to any disclaimer, the term of this patent is extended or adjusted under 35 U.S.C. 154(b) by 0 days.

(21) Appl. No.: 15/548,001

(22) PCT Filed: Feb. 5, 2015

(86) PCT No.: PCT/IT2015/000026
§ 371 (c)(1),
(2) Date: Aug. 1, 2017

(87) PCT Pub. No.: WO2016/125196
PCT Pub. Date: Aug. 11, 2016

(65) Prior Publication Data

US 2018/0023912 A1 Jan. 25, 2018

(51) Int. Cl.
*F41A 19/46* (2006.01)
*F41A 5/02* (2006.01)
(Continued)

(52) U.S. Cl.
CPC ..... *F41A 19/46* (2013.01); *F41A 3/54* (2013.01); *F41A 5/02* (2013.01); *F41A 9/55* (2013.01);
(Continued)

(58) Field of Classification Search
CPC .. F41A 3/54; F41A 19/12; F41A 19/33; F41A 19/14; F41A 5/02; F41A 17/72;
(Continued)

(56) References Cited

U.S. PATENT DOCUMENTS 2,466,017 A * 4/1949 Farber ..... F41A 9/83 42/72
3,651,736 A * 3/1972 Ingram ..... F41A 3/54 89/132
(Continued)

FOREIGN PATENT DOCUMENTS

DE 46761 C 5/1889

OTHER PUBLICATIONS

International Search Report dated Sep. 29, 2015; International Application No. PCT/IT2015/000026; dated Feb. 5, 2015; 6 pages.
(Continued)

*Primary Examiner* — Jonathan C Weber
(74) *Attorney, Agent, or Firm* — Blank Rome LLP

(57) ABSTRACT

An automatic submachine gun for exploiting recoil, that includes a stock; a fixed barrel; a grip provided with an extractable butt; a bolt sliding in direction parallel to the longitudinal axis of the barrel inside the stock for locking the breech of the barrel; a device for recovering the recoil kinetic energy of the bolt; a hammer swinging in opposition and through the action of a spring actuator element between a cocked position and an uncocked position; a trigger assembly for the hammer; an opposing lever of the hammer for single shot fire; and an opposing lever of the hammer for continuous burst fire; a manual fire mode selector; an extractable magazine for loading cartridge ammunition; and a firing pin.

13 Claims, 20 Drawing Sheets

(51) Int. Cl.

| | |
|---|---|
| ***F41A 19/14*** | (2006.01) |
| ***F41A 3/54*** | (2006.01) |
| ***F41A 9/55*** | (2006.01) |
| ***F41A 9/69*** | (2006.01) |
| ***F41A 9/70*** | (2006.01) |
| ***F41A 11/00*** | (2006.01) |
| ***F41A 15/14*** | (2006.01) |
| ***F41A 17/72*** | (2006.01) |
| ***F41A 19/12*** | (2006.01) |
| ***F41A 21/34*** | (2006.01) |
| ***F41C 23/04*** | (2006.01) |
| ***F41G 1/02*** | (2006.01) |
| ***F41A 19/45*** | (2006.01) |
| *F41A 5/08* | (2006.01) |
| *F41A 5/10* | (2006.01) |
| *F41C 7/00* | (2006.01) |

(52) U.S. Cl.
CPC *F41A 9/69* (2013.01); *F41A 9/70* (2013.01); *F41A 11/00* (2013.01); *F41A 15/14* (2013.01); *F41A 17/72* (2013.01); *F41A 19/12* (2013.01); *F41A 19/14* (2013.01); *F41A 19/45* (2013.01); *F41A 21/34* (2013.01); *F41C 23/04* (2013.01); *F41G 1/02* (2013.01); *F41A 5/08* (2013.01); *F41A 5/10* (2013.01); *F41C 7/00* (2013.01)

(58) Field of Classification Search
CPC .... F41A 9/55; F41A 9/70; F41A 21/34; F41A 23/04; F41A 11/00; F41A 15/14; F41A 19/27; F41A 19/46; F41G 1/02
USPC .... 89/129.01, 142, 190, 136, 194, 197, 128, 89/129.02; 42/71.02, 73
See application file for complete search history.

(56) References Cited

U.S. PATENT DOCUMENTS

| | | | | |
|---|---|---|---|---|
| 3,774,500 | A * | 11/1973 | Into | F41A 19/02 89/129.01 |
| 4,004,496 | A | 1/1977 | Snodgrass | |
| 4,109,559 | A * | 8/1978 | Davis | F41A 19/10 42/71.02 |
| 6,564,492 | B2 * | 5/2003 | Weldle | F41C 23/14 42/73 |

OTHER PUBLICATIONS

Written Opinion dated Sep. 29, 2015; International Application No. PCT/IT2015/000026; dated Feb. 5, 2015; 12 pages.
Retrieved from the Internet: URL:https://en.wikipedia.org/wiki/CAR-15; *the paragraph entitled "Colt Model 653 M16A1 Carbine"; retrieved Sep. 28, 2015; 2 pages.
English translation; German Application No. 46761 dated Oct. 1888; 4 pages.

* cited by examiner

AUTOMATIC SUBMACHINE GUN FOR EXPLOITING RECOIL COMPRISING TWO OPPOSING LEVERS FOR THE HAMMER, ONE ASSOCIATED WITH SINGLE-SHOT FIRING MODE AND THE OTHER WITH BURST FIRING MODE

RELATED APPLICATIONS

This application is a U.S. national phase application of International Application No. PCT/IT2015/000026, filed Feb. 5, 2015; which application is incorporated by reference.

FIELD OF USE

The present invention relates to an automatic submachine gun for exploiting recoil.

BACKGROUND OF THE INVENTION

In the field of weaponry, various types of submachine guns are known which can be used like a normal pistol, held with either one or two hands, or else, using the extractable butt housed in the grip, like a carbine.

Such submachine guns can have various drawbacks tied to the inconvenience of using them due, for example, to the limited capacity of containment of the barrel bounce and perceived recoil, excessive weight and excessive bulkiness.

Other known submachine guns also pose problems tied to the limited safety of use, and imprecise operation which can be a cause, for example, of premature discharge.

SUMMARY OF THE INVENTION

The technical task of the invention is to provide an automatic submachine gun for exploiting recoil which overcomes the drawbacks of the prior art.

Within the scope of this technical task, one object of the invention is to provide an automatic submachine gun for exploiting recoil which is ergonomic, convenient and simple to use, long lasting, safe and precise in its operation.

This and other objects according to the invention are achieved by an automatic submachine gun for exploiting recoil comprising: a stock; a fixed barrel; a grip provided with an extractable butt; a bolt sliding in a direction parallel to the axis of the barrel inside the stock to lock the breech of the barrel; a device for recovering the recoil kinetic energy of the bolt; a hammer swinging in opposition and through the action of a spring actuator element between a cocked position and an uncocked position; a trigger assembly for the hammer, in turn comprising a swinging trigger pivoted on the stock and operatively connected to a sear lever, an opposing lever of the hammer for single shot fire actuatable by the sear lever, and an opposing lever of the hammer for continuous burst fire actuatable by the sear lever; a manual fire mode selector connected to a rotating shaft having a cam means interacting with said opposing lever of the hammer for single shot fire and with said opposing lever of the hammer for burst fire; an extractable magazine for loading cartridge ammunition into a cartridge chamber of the barrel; a firing pin for the ammunition actuatable by the hammer and sliding in a direction parallel to the axis of the barrel in a seat provided in the bolt; said hammer being configured and disposed so as to interact with the bolt in such a way as to absorb a significant fraction of the recoil kinetic energy of the bolt for the attainment of the cocked position.

In a preferred embodiment of the invention said hammer has a rotation pin positioned above the axis of the barrel.

In a preferred embodiment of the invention, said hammer has a point of impact with the firing pin situated below said rotation pin.

In a preferred embodiment of the invention said hammer has a point of impact with the bolt situated below the said rotation pin and above said point of impact with the firing pin.

In a preferred embodiment of the invention, said hammer has a centre of mass positioned below the point of impact with the bolt.

In a preferred embodiment of the invention, in the interaction of the hammer with the bolt, the length of the movement of the centre of mass of the hammer is amplified compared to the length of the movement of the bolt.

In a preferred embodiment of the invention, the trigger assembly for the hammer comprises an opposing lever of the hammer for preventing a premature discharge actuatable by the bolt on attaining its locked position.

In a preferred embodiment of the invention, the selector is solidly joined in rotation with said shaft and is rotatable into a first angular position in which the cam means blocks at least one of the opposing levers of the hammer for single shot fire and for burst fire, a second angular position in which the cam means does not interfere with the opposing levers of the hammer for single shot fire and for burst fire, and a third angular position in which the cam means disengages the opposing lever of the hammer for single shot fire from the hammer.

In a preferred embodiment of the invention, for single shot fire said sear lever has a cam engageable by the bolt so as to rotate the sear lever into a position of disconnection from the opposing lever of the hammer for single shot fire when the trigger is pressed.

In a preferred embodiment of the invention, the magazine, of the two-row type with individual exposure of the cartridge, has an asymmetrical placement of its retaining lips for the first cartridge, such as to place the first cartridge in an offset position relative to the median longitudinal axis of the magazine.

In a preferred embodiment of the invention, the stock has a ramp for feeding the cartridge into the breech of the barrel, the ramp being laterally offset relative to the longitudinal axis of the barrel.

In a preferred embodiment of the invention, the butt slides along a curved guide between a retracted position and an extracted position which is lower than the retracted position.

In a preferred embodiment of the invention, the submachine gun comprises a device for automatically locking the bolt in the open position after the last ammunition present in the magazine has been discharged, and a manual bolt release actuating lever.

In a preferred embodiment of the invention, the submachine gun comprises on the front a removable sleeve encircling the barrel and the front part of the stock and of the grip, said sleeve housing a device for manually cocking the hammer which comprises a swinging cocking handle pivoted to a support translatable along a linear guide parallel to the longitudinal axis of the barrel.

In a preferred embodiment of the invention, the head of the bolt has on top of it a plate for deflecting the cartridge case.

In a preferred embodiment of the invention, on the bolt there is mounted a cartridge case extractor having a catch for retaining the cartridge case head, positioned in front of the bolt head, said catch being pivotable between a position of retaining and a position of releasing the cartridge case head in opposition and through the action of a spring.

In a preferred embodiment of the invention, the submachine gun has an automatic device for locking the trigger comprising a swinging lever engaged with the trigger and engageable with a stop fashioned in the stock.

In a preferred embodiment of the invention, the submachine gun comprises a device for automatically locking the firing pin when the trigger is not pressed, comprising a peg housed in a seat fashioned in the bolt, said peg being translatable transversely to the firing pin through the action of the opposing lever of the hammer for continuous burst fire in opposition to a spring between a position of interference with the firing pin and a position of non-interference with the firing pin.

In a preferred embodiment of the invention, screwed onto the muzzle of the barrel, where first slots passing through the thickness of the wall of the barrel are present, there is at least one flame-extinguishing cylindrical element comprising second slots passing through the thickness of the wall of the cylindrical element and offset from the first slots.

In a preferred embodiment of the invention, on said barrel, between said flame-extinguishing cylindrical element and an outer shoulder of said barrel, there is fitted a bushing-shaped support for a sight having at least one anti-rotation abutting element engageable in a corresponding seat fashioned on the barrel, and said support for a sight supports a peg for preventing the flame-extinguishing cylindrical element from coming unscrewed, said peg sliding in opposition and through the action of a spring, and being configured and disposed to be inserted in a corresponding seat fashioned on the flame-extinguishing cylindrical element.

The submachine gun according to the invention thus functions so as to exploit recoil, has a blowback system given by the mass of the bolt, to which, thanks to a particular solution, the mass of the hammer is added. Operation is automatic, whereas repeating can take place, alternatively and at the user's choice, in a semiautomatic manner (single shot fire), or an automatic one (continuous burst fire).

The start of the firing cycle takes place with the bolt closed. The trigger assembly is of the single action type.

After the last shot contained in the magazine is fired, the bolt remains automatically locked in the open position. A manual ambidextrous lever determines, at the user's choice, the immediate return into the closed position.

Given its configuration, the weapon can be employed—at the user's choice—as a normal pistol, held either with one or two hands, or else, using the extractable butt housed in the grip, as a carbine.

There is further preferably provided a front grip for the so-called "weak hand", which may be used at the user's choice. If he decides to use it, the front grip must simply be rotated downward by 90 degrees. Otherwise, the front grip remains housed in the front sleeve of the barrel.

The particular attention dedicated, at the design stage, to ergonomics—more specifically, the containment of barrel bounce and of perceived recoil—facilitate the use of the weapon in all the cases just mentioned.

It should be considered, moreover, again for the purposes of an ergonomic use, that all the controls of the weapon are ambidextrous, or reversible right hand/left hand, with the sole exception of the cocking handle.

BRIEF DESCRIPTION OF THE DRAWINGS

Additional features and advantages of the invention will be more apparent from the description of a preferred, but not exclusive embodiment of the submachine gun according to the invention, illustrated by way of illustration and not by way of limitation in the appended drawings, in which.

DETAILED DESCRIPTION OF THE ILLUSTRATED EMBODIMENTS

Figure 1:
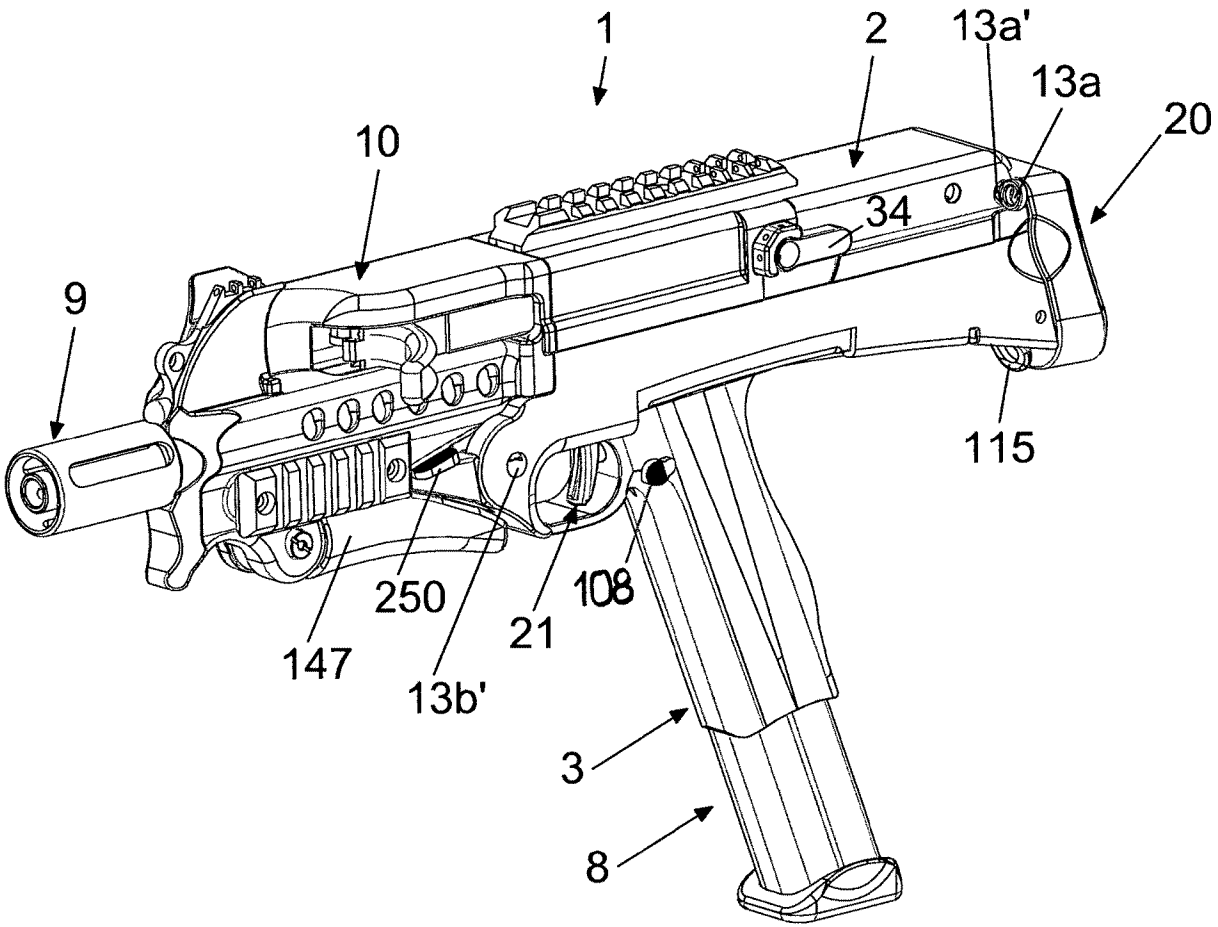
FIG. 1 shows a perspective view of the submachine gun with the butt closed.
Figure 2:
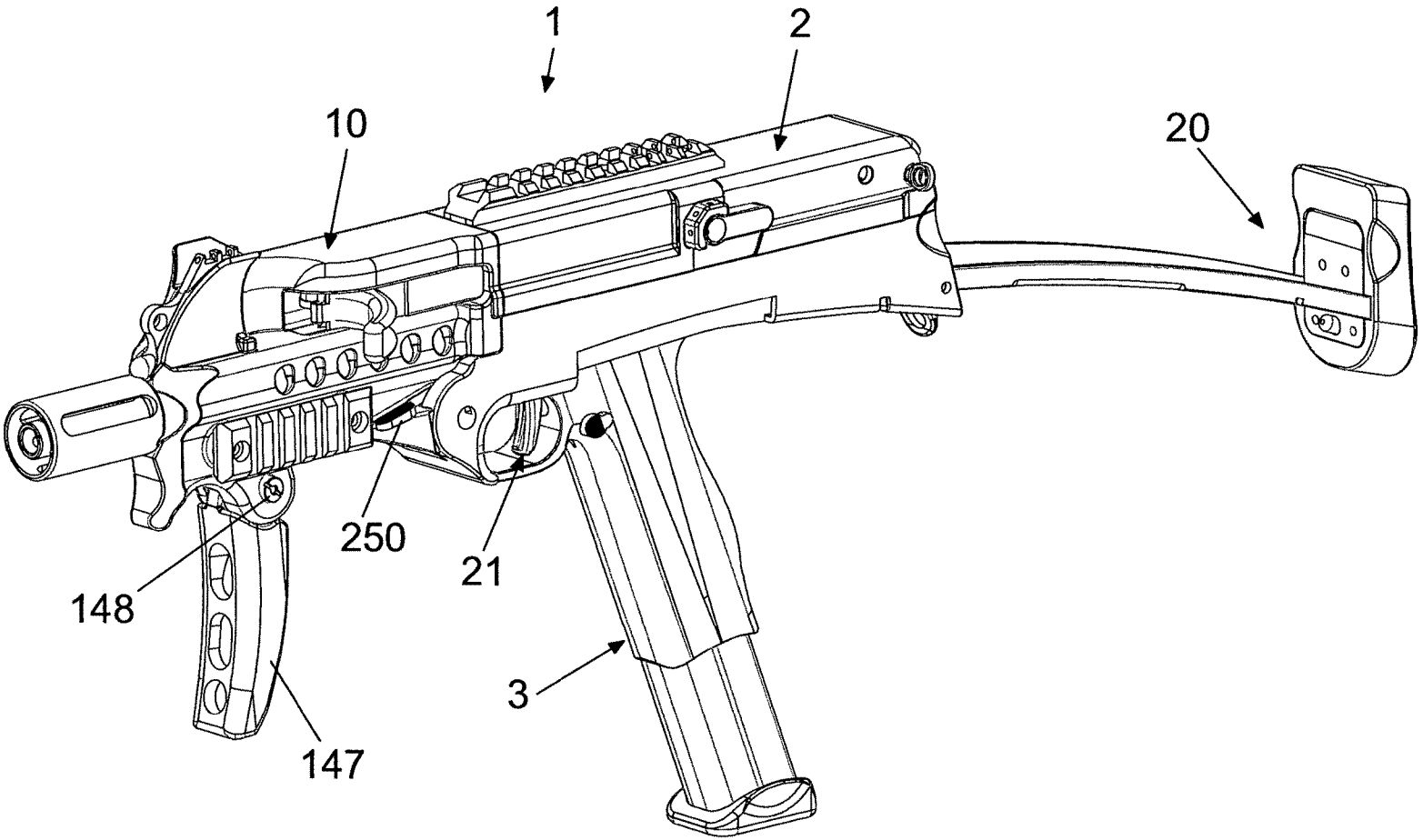
FIG. 2 shows a perspective view of the submachine gun with the butt open.
Figure 3:
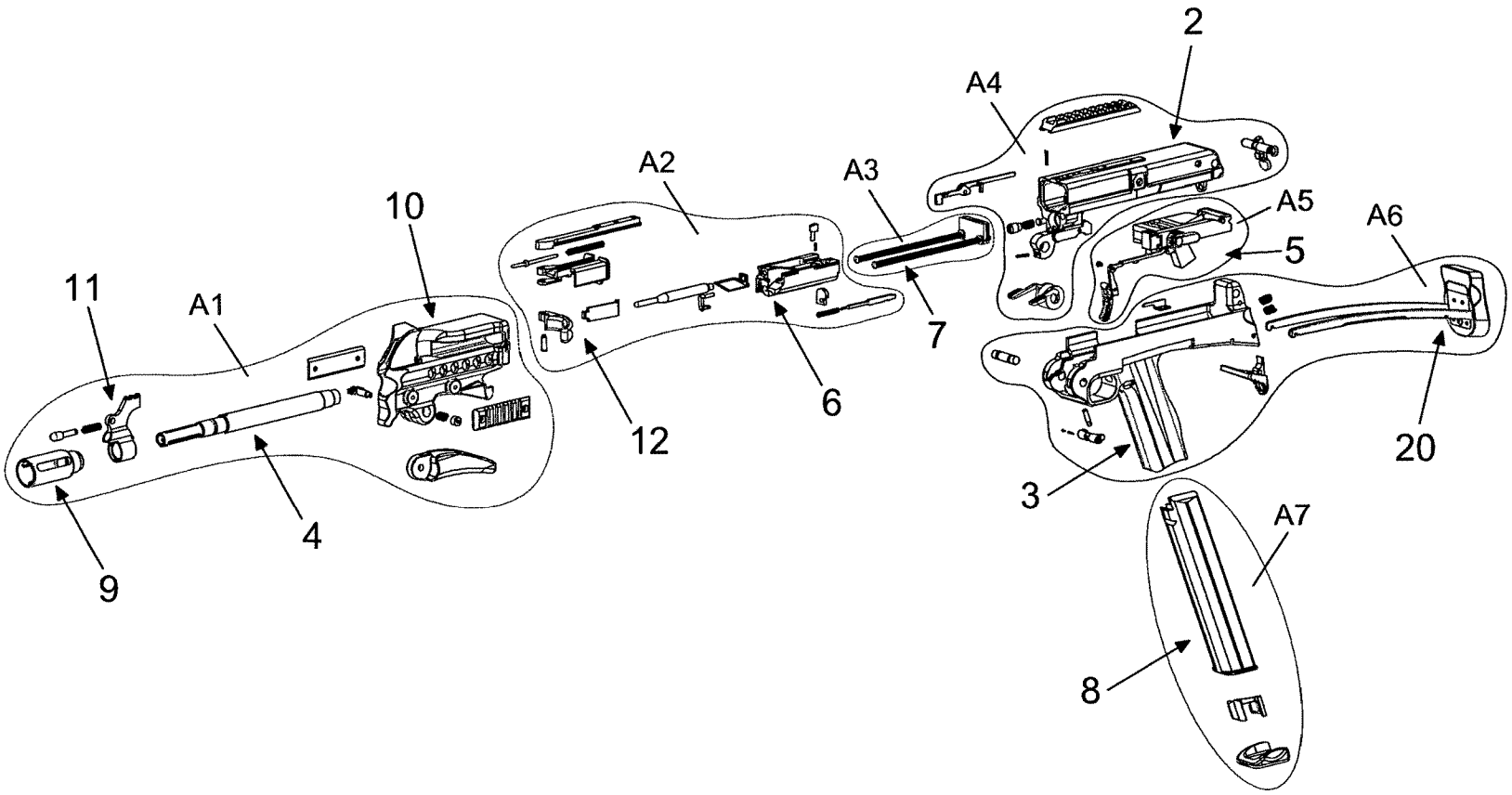
FIG. 3 shows a general exploded view of the submachine gun.
Figure 4:
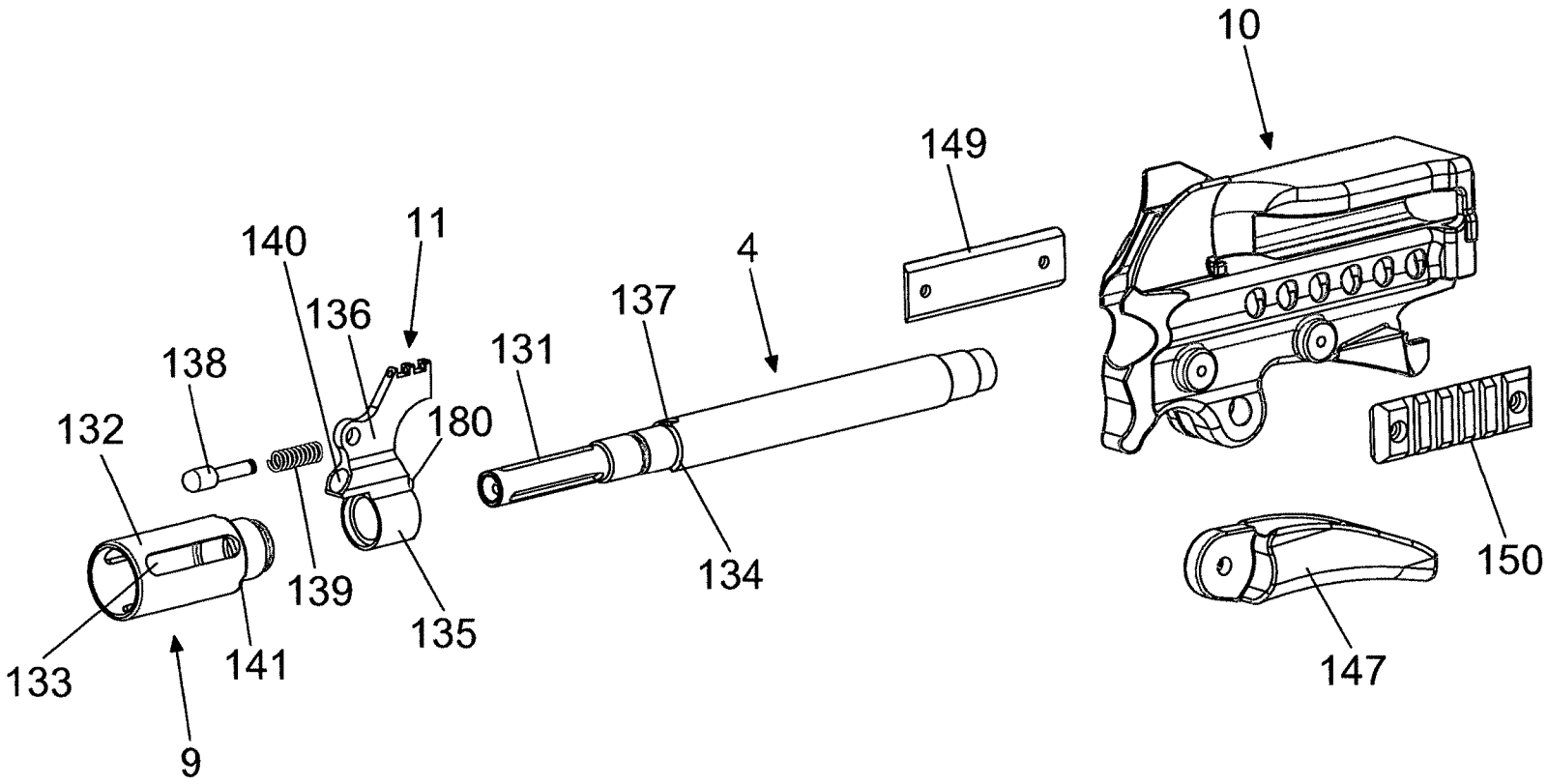
FIG. 4 shows an enlargement of the exploded view A1 of FIG. 3.
Figure 5A:
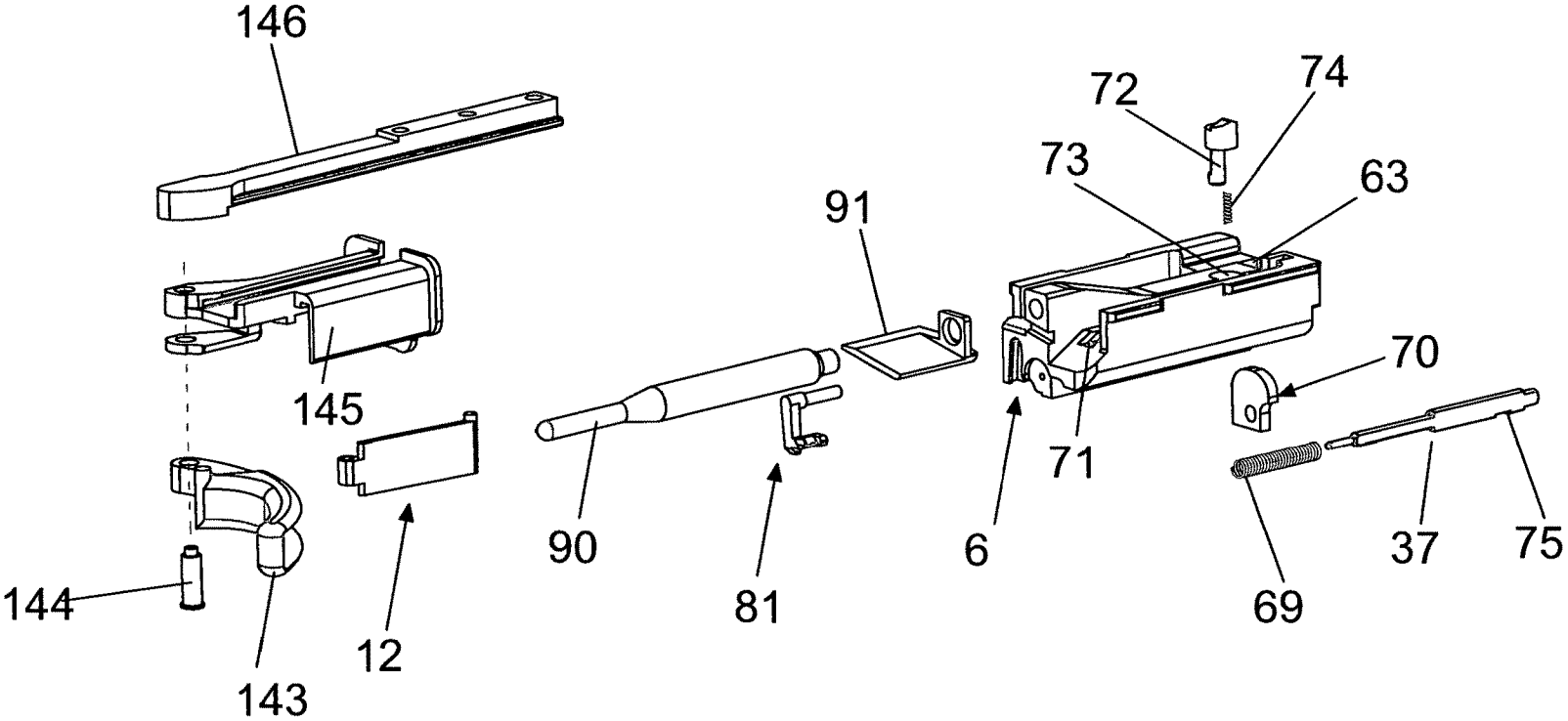
FIG. 5*a* shows an enlargement of the exploded view A2 of FIG. 3
Figure 5B:
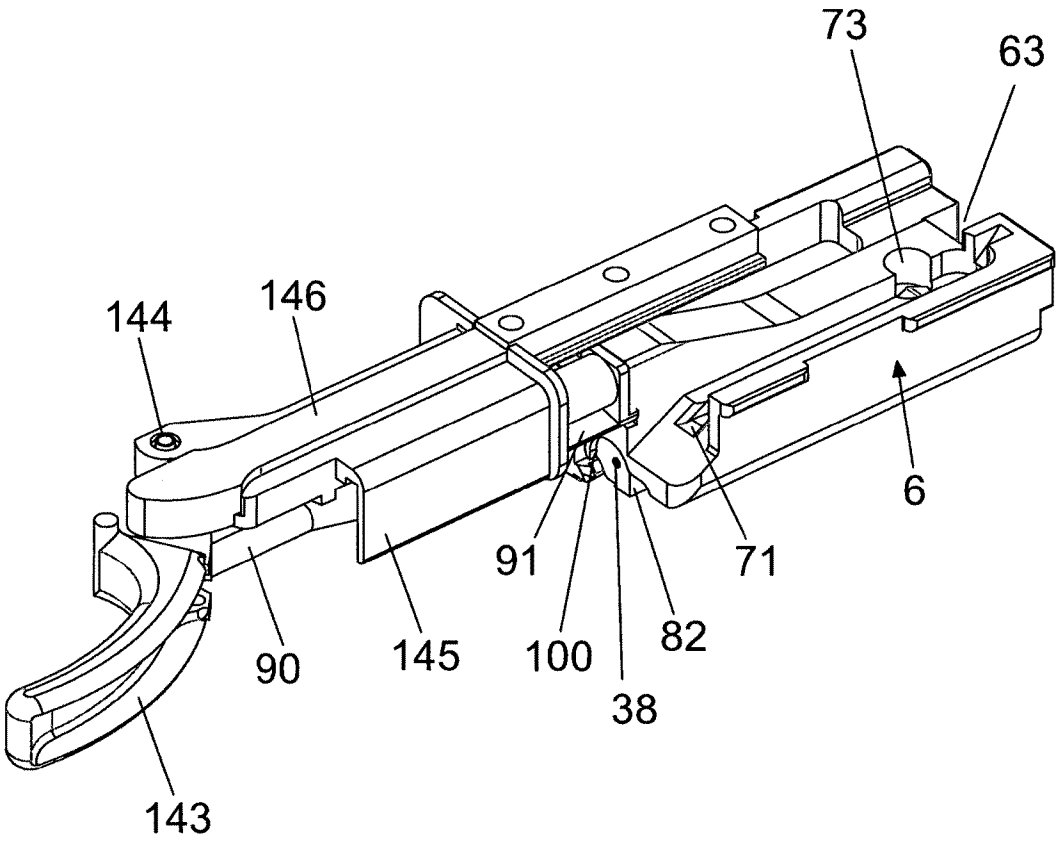
FIG. 5*b* shows the assembled cocking mechanism.
Figure 6B:
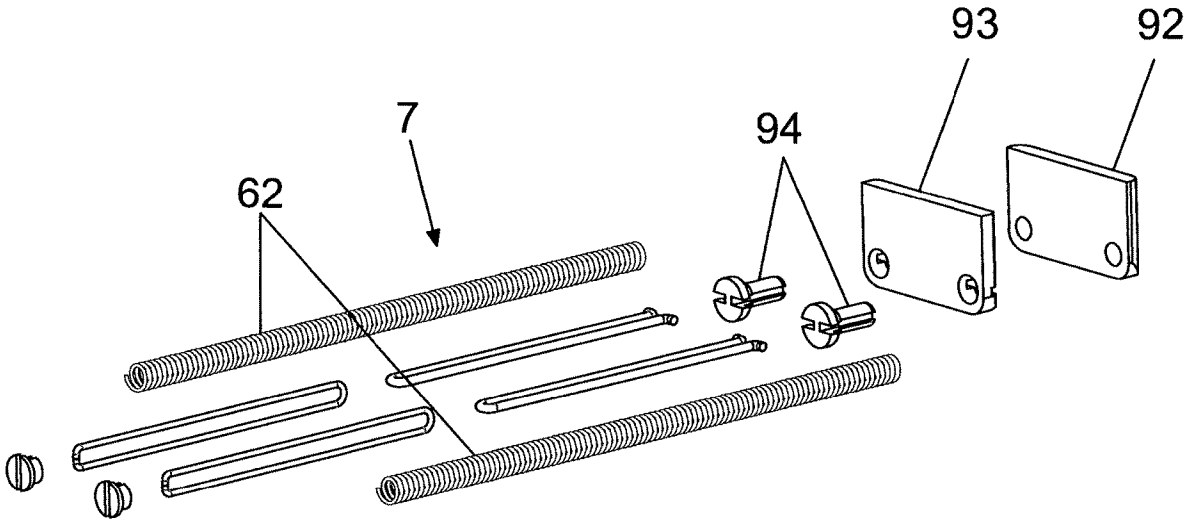
FIGS. 6*a* and 6*b* show a enlargement of the assembly A3 of FIG. 3 in an assembled and exploded view, respectively.
Figure 6A:
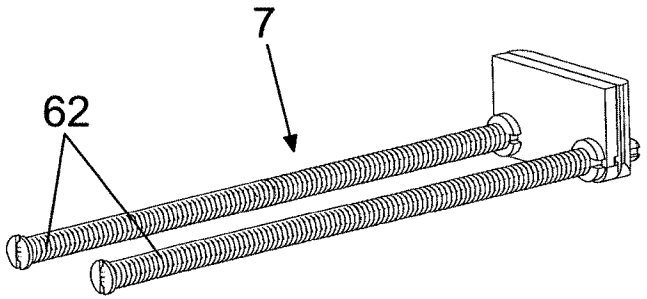
Figure 7:
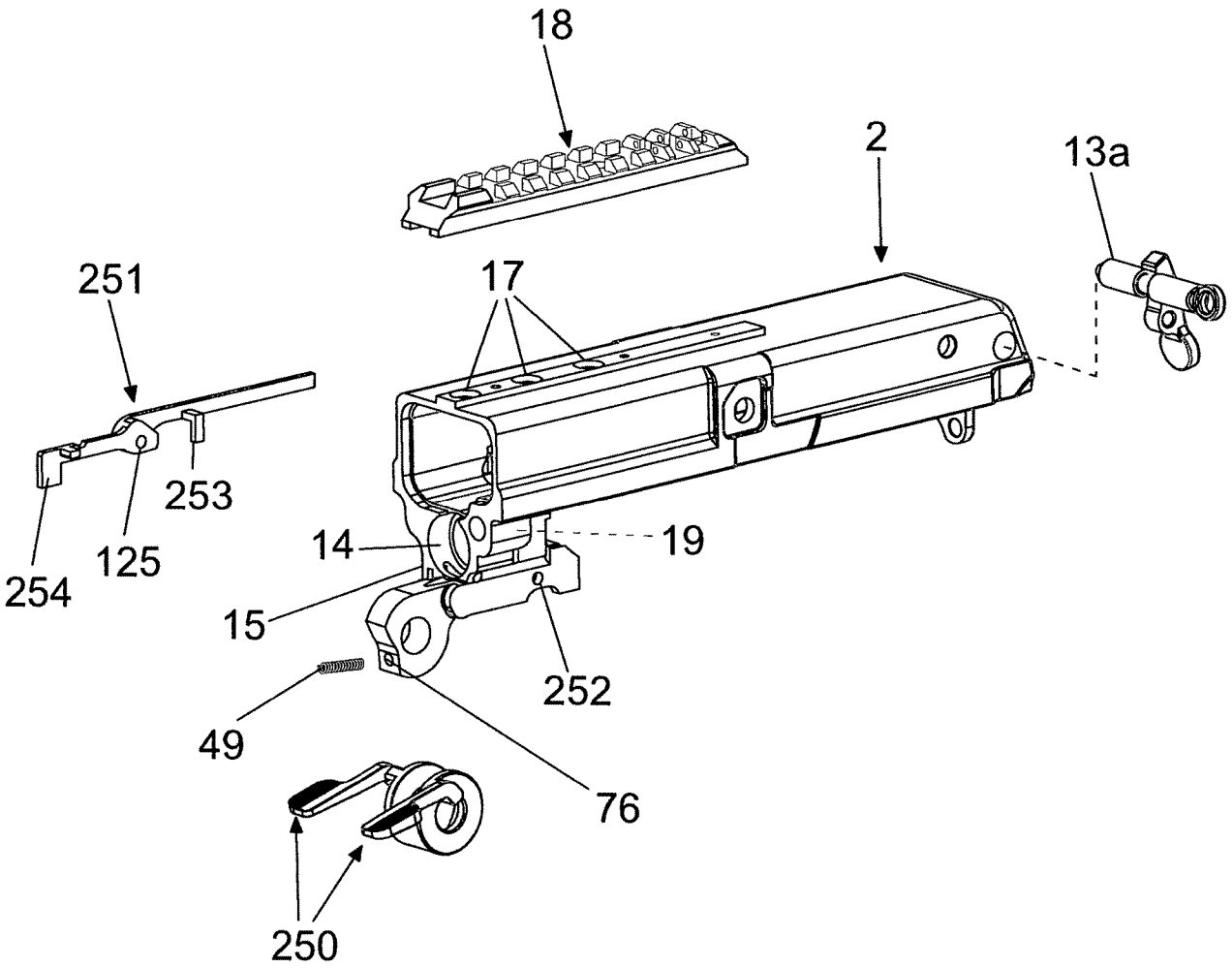
FIG. 7 shows an enlargement of the exploded view A4 of FIG. 3.
Figure 8:
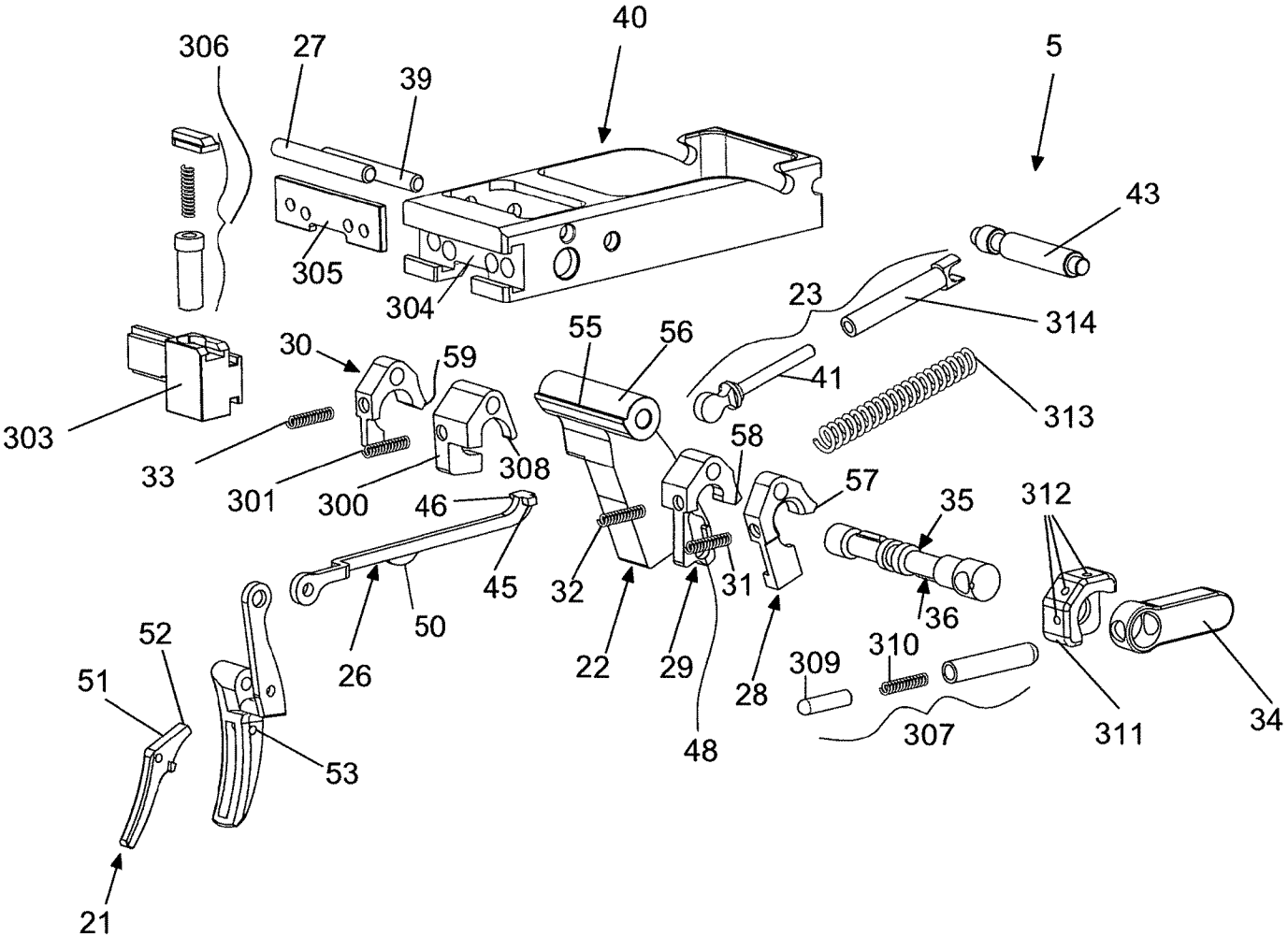
FIG. 8 shows an enlargement of the exploded view A5 of FIG. 3.
Figure 9:
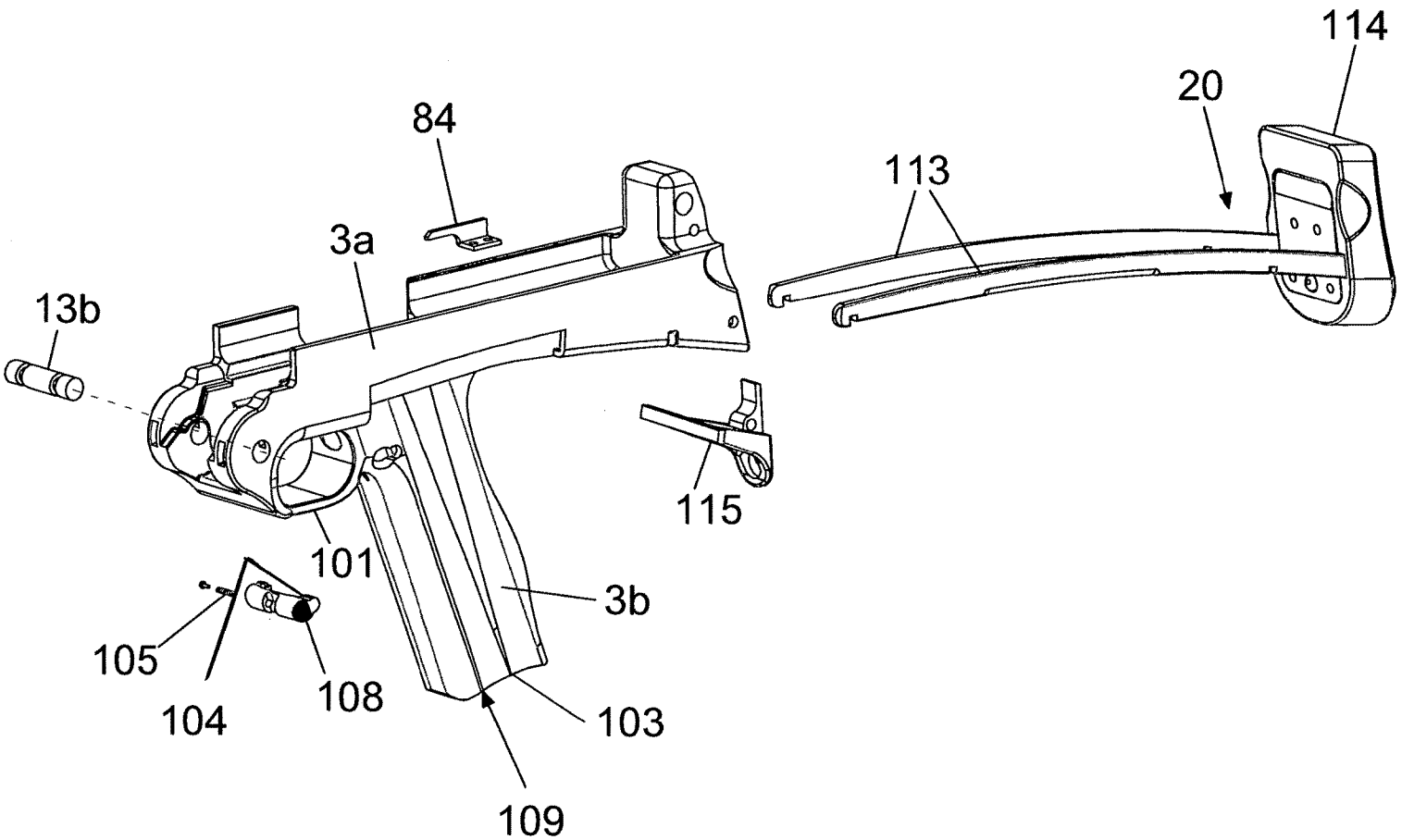
FIG. 9 shows an enlargement of the exploded view A6 of FIG. 3.
Figure 10A:
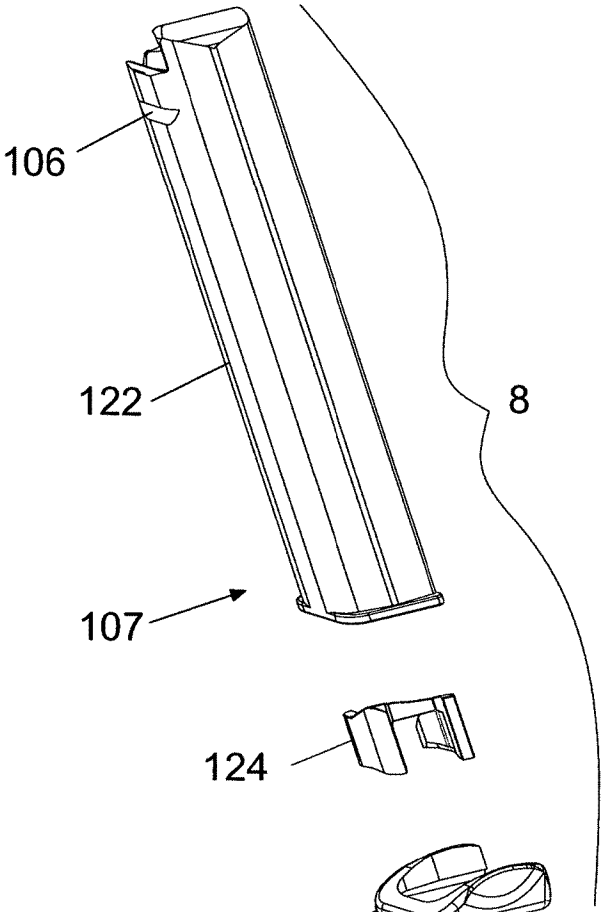
FIGS. 10*a* and 10*b* show an enlargement of the exploded view A3 of FIG. 3 and a sectional view of the assembled magazine, respectively.
Figure 10B:
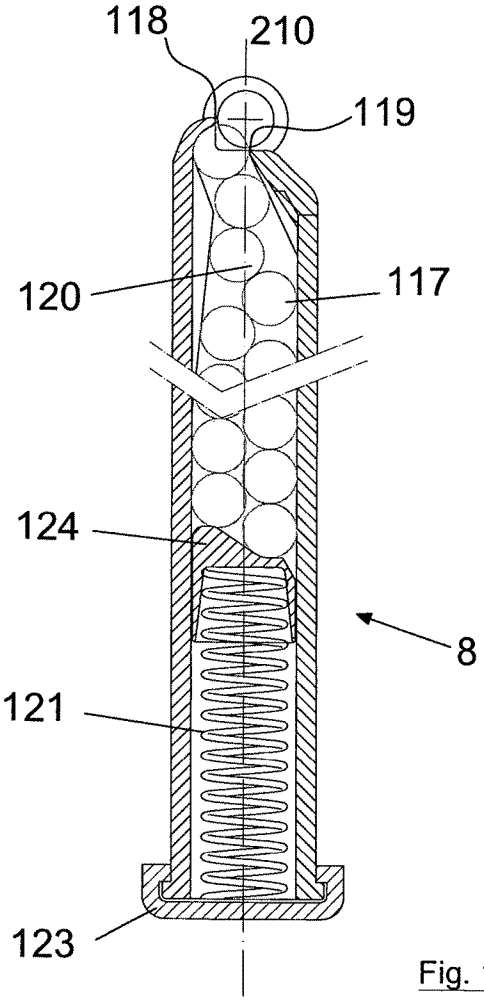
Figure 11A:
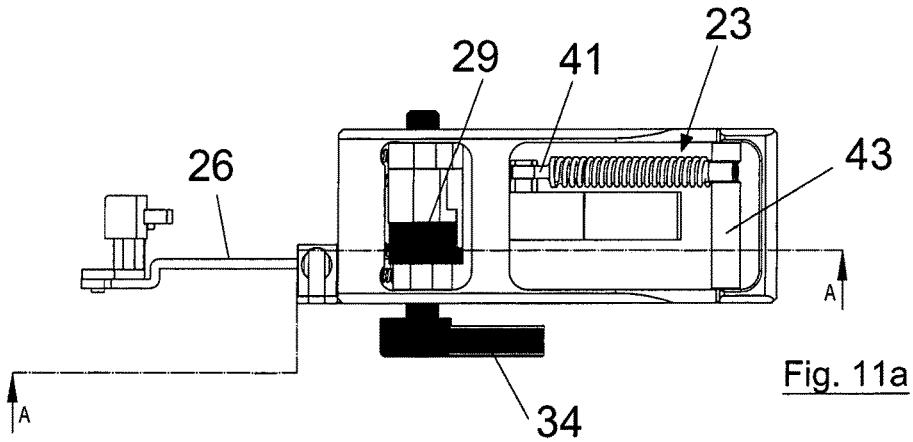
FIGS. 11*a* and 11*b* show the trigger assembly with the selector in the safety position.
Figure 11B:
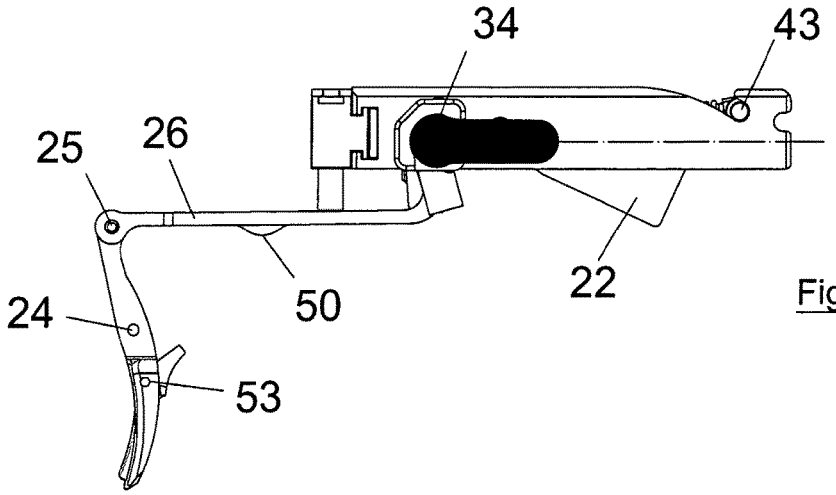
Figure 11C:
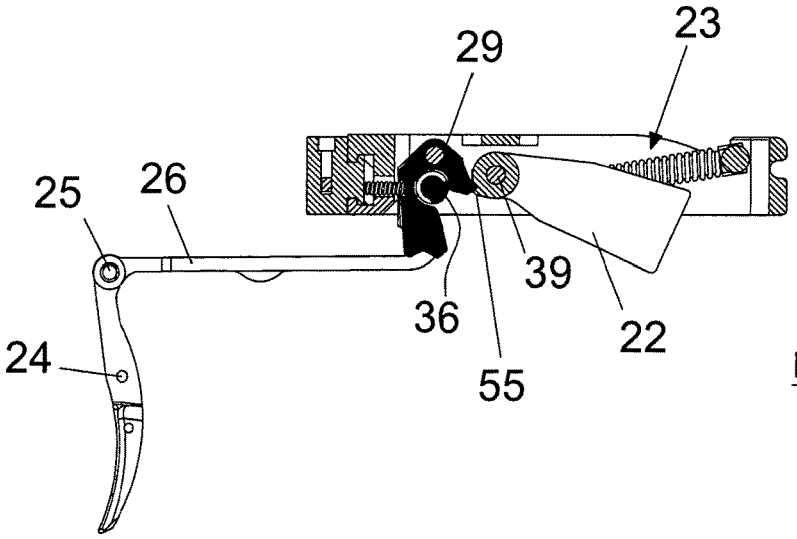
FIG. 11*c* shows a sectional view of the trigger assembly along the line A-A of FIG. 11*a;*
Figure 12A:
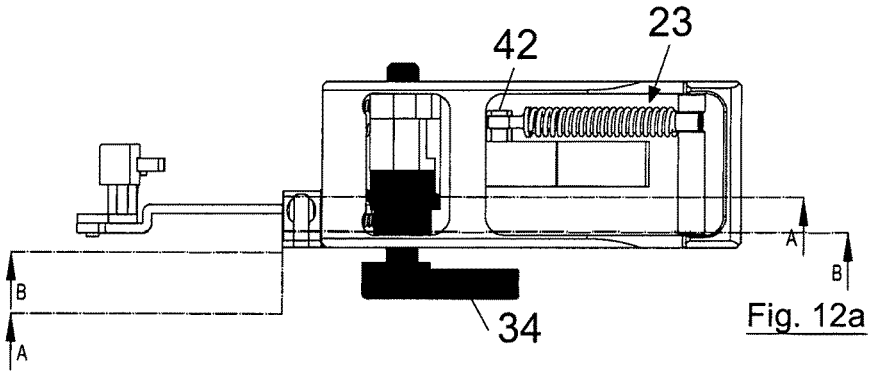
FIGS. 12*a* and 12*b* show the trigger assembly with the selector in the position of enabling single shot fire.
Figure 12B:
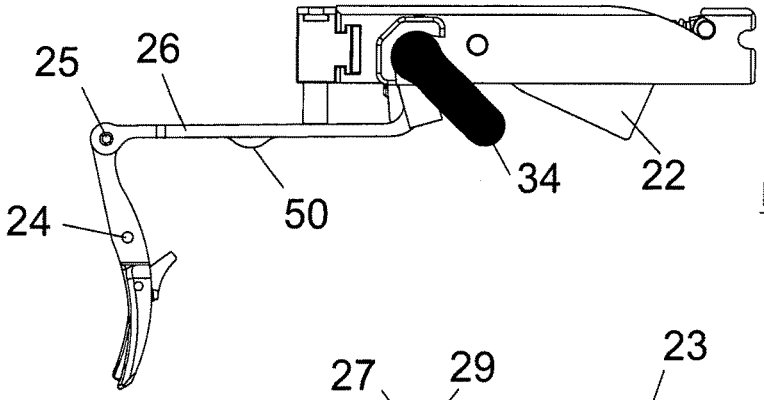
Figure 12C:
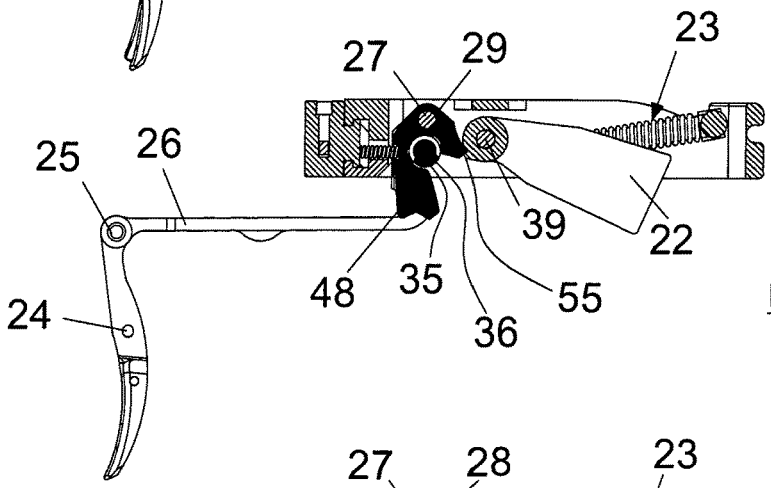
FIGS. 12*c* and 12*d* show, respectively, a sectional view of the trigger assembly along the line A-A of FIG. 12*a* and along the line B-B of FIG. 12*a*, respectively.
Figure 12D:
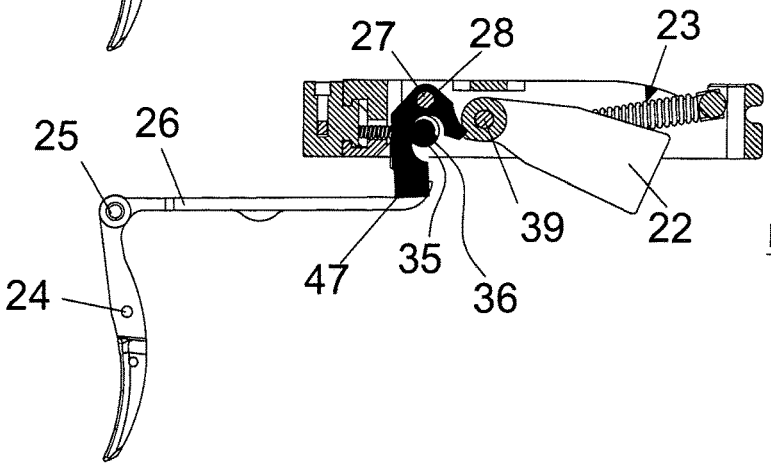
Figure 13A:
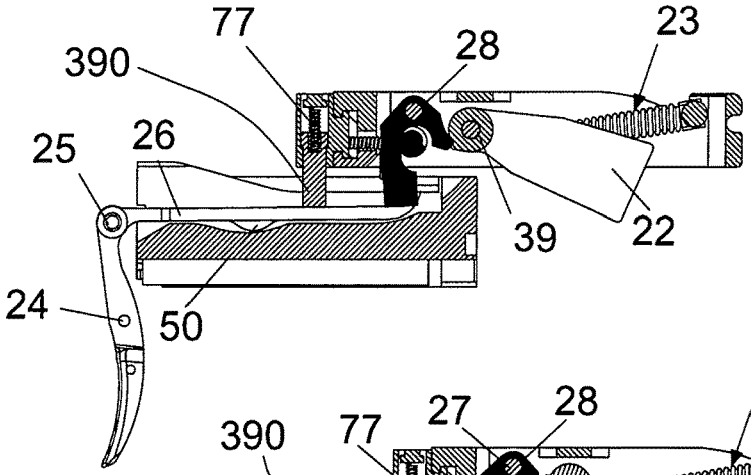
FIGS. 13*a*, 13*b*, 13*c*, 13*d* show the trigger assembly in a sectional view along the line B-B of FIG. 12*a* in the phases of disconnection of the opposing lever of the hammer for single shot fire.
Figure 13B:
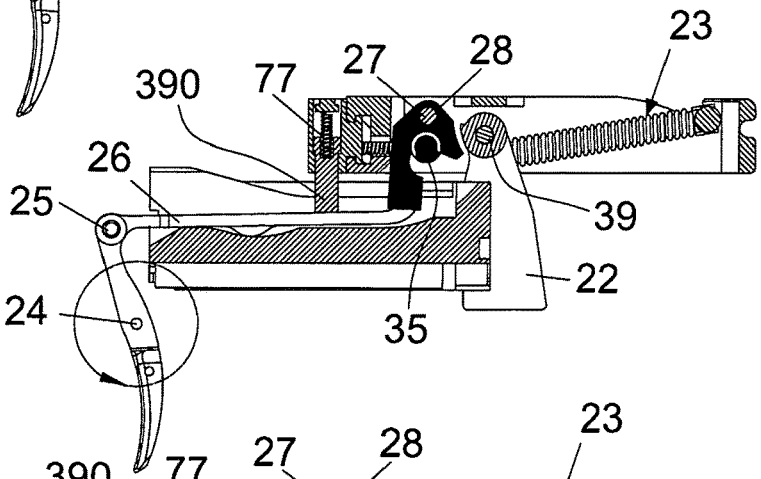
Figure 13C:
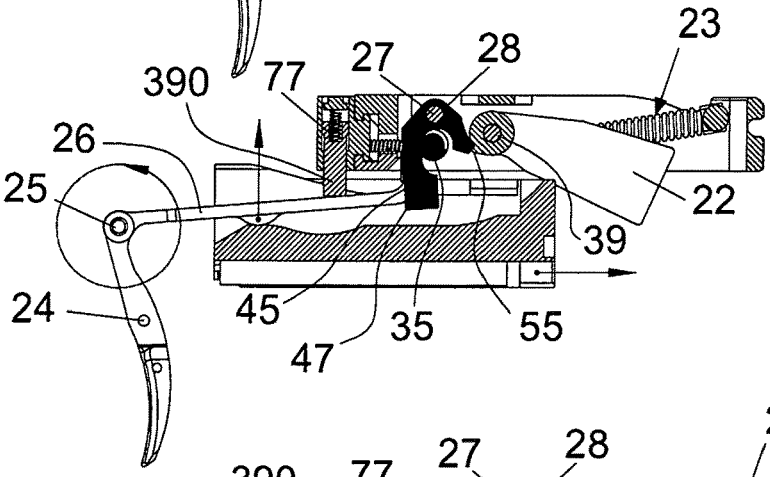
Figure 13D:
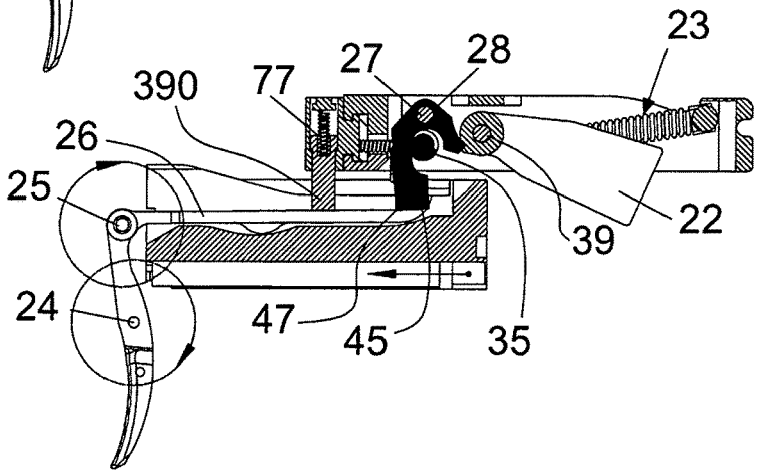
Figure 14A:
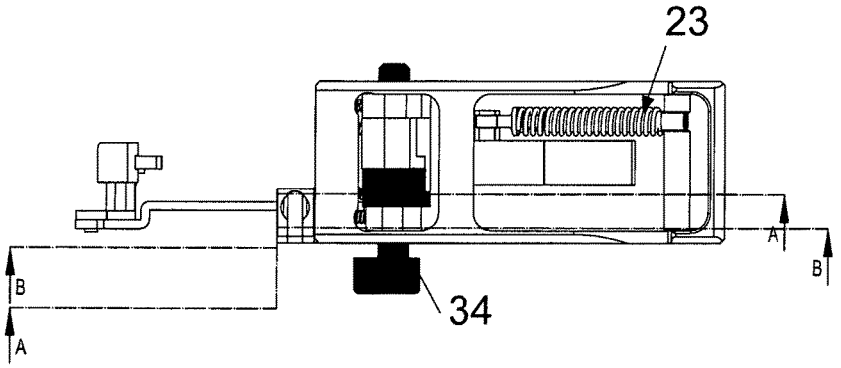
FIGS. 14*a* and 14*b* show the trigger assembly with the selector in the position of enabling burst fire, and FIGS. 14*c* and respectively 14*d* show a sectional view of the trigger assembly along the line A-A of FIG. 14*a* and along the line B-B of FIG. 14*a*, respectively.
Figure 14B:
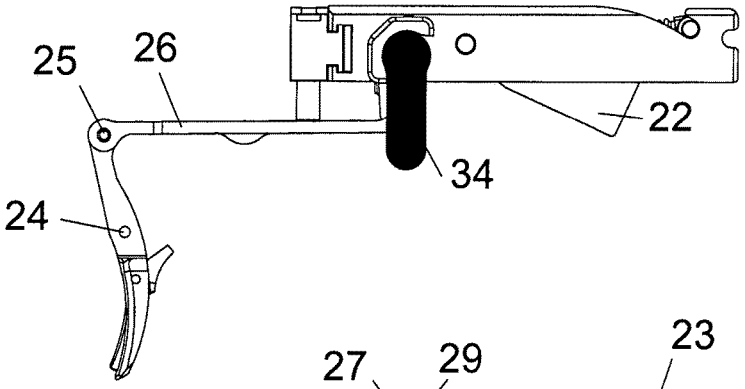
Figure 14C:
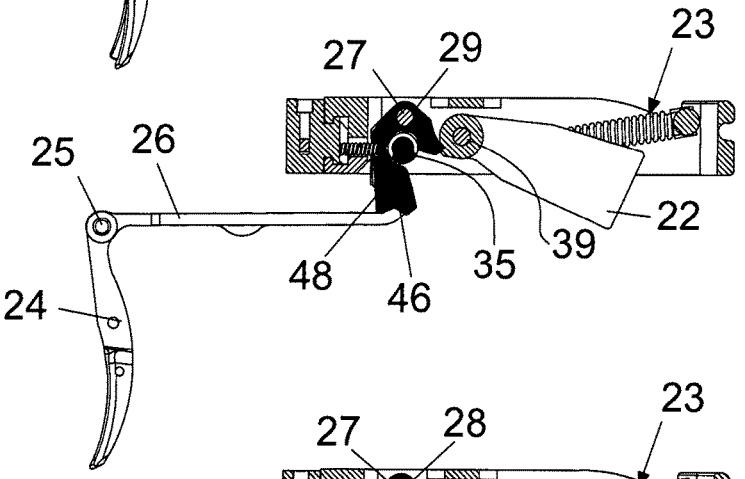
Figure 14D:
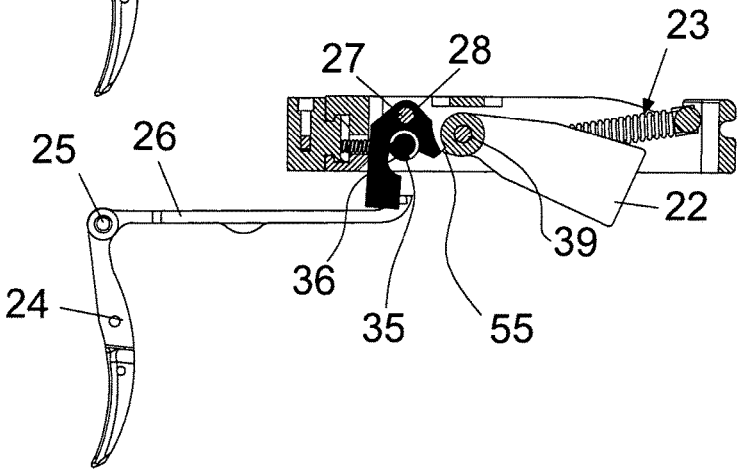
Figure 15A:
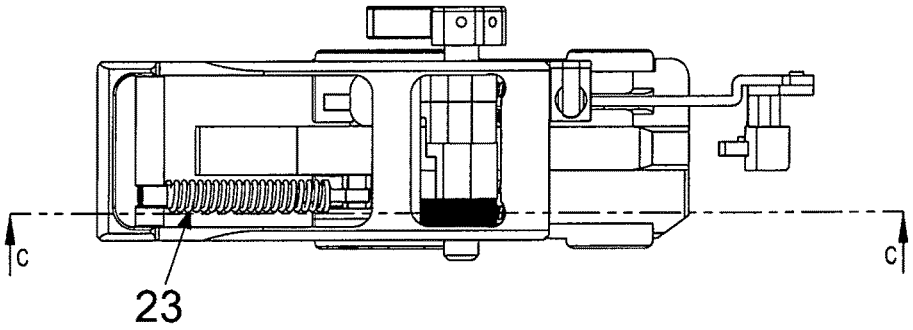
FIG. 15*a* shows the trigger assembly and FIGS. 15*b* and respectively 15*c* show a sectional view of the trigger assembly along the line C-C of FIG. 15*a* with the bolt in open position, in which the opposing lever which prevents premature discharge engages the hammer and, respectively, with the bolt in the closed position in which the opposing lever which prevents premature discharge has released the hammer.
Figure 15B:
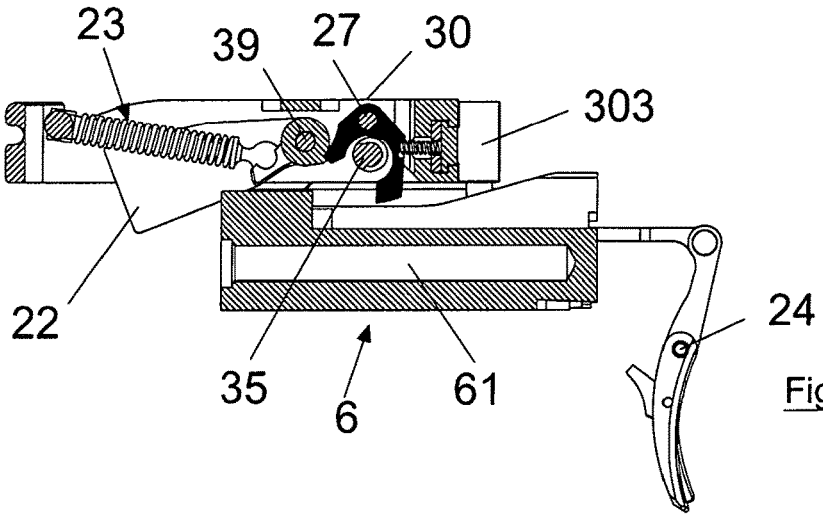
Figure 15C:
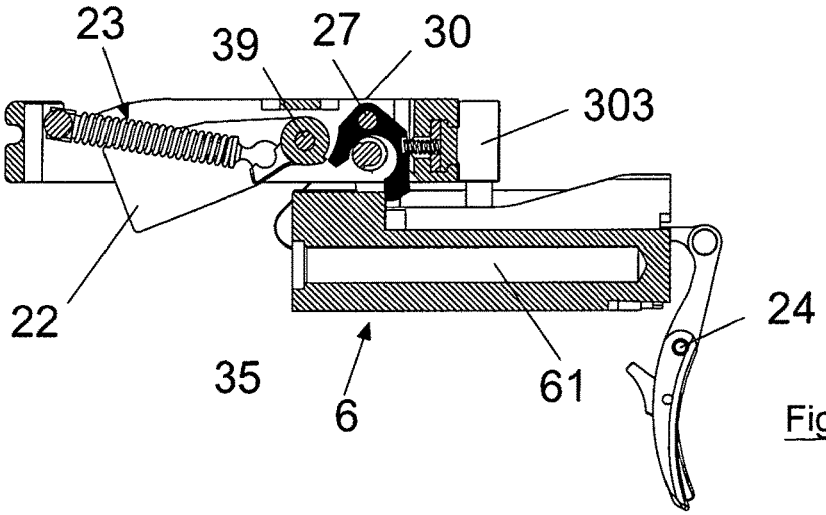
Figure 16A:
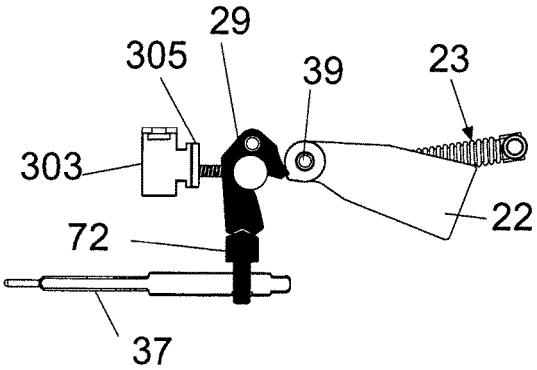
FIGS. 16*a*, 16*b*, show the safety system for the firing pin with the firing pin locked.
Figure 16B:
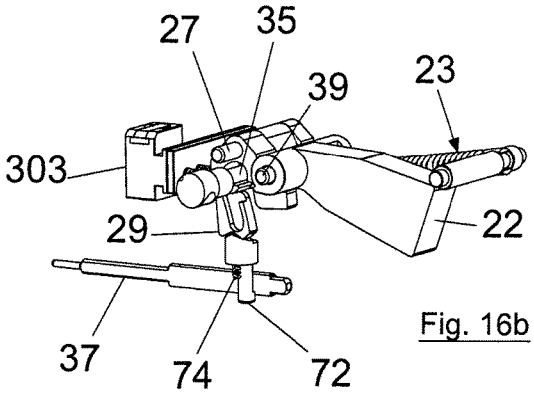
Figure 16C:
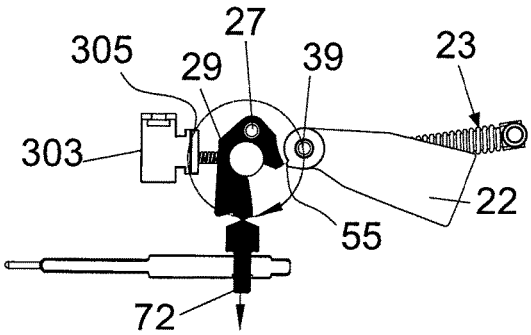
FIGS. 16*c*, 16*d*, show the safety system for the firing pin with the firing pin released.
Figure 16D:
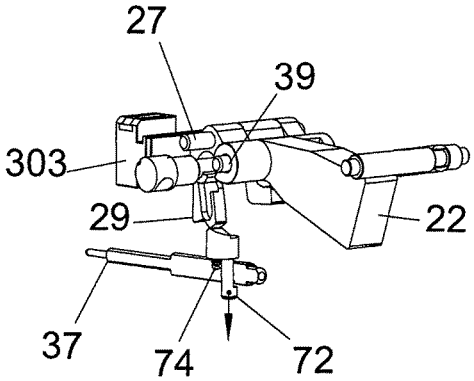
Figure 17C:
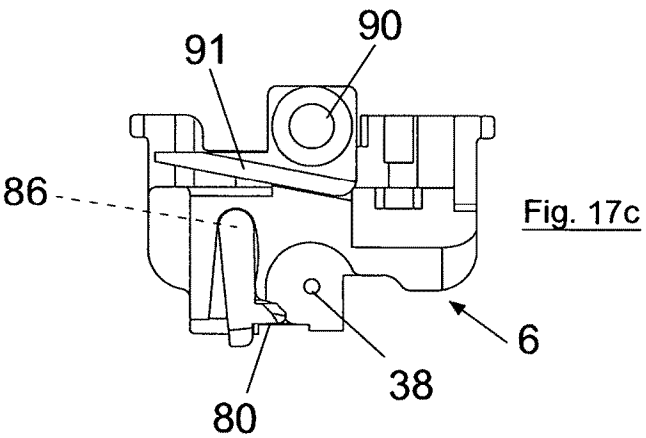
FIG. 17*c* shows the bolt with the extractor in the position of retaining the case head.
Figure 17B:
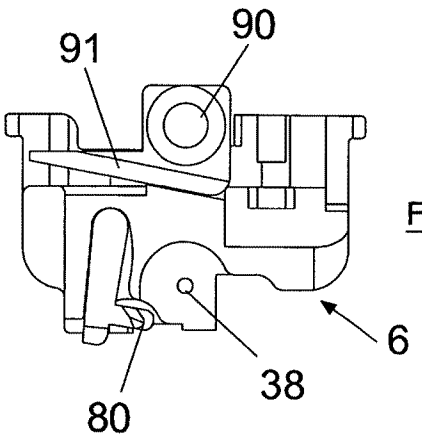
FIGS. 17*a*, 17*b* show the bolt with the extractor in the position of releasing the case base.
Figure 17A:
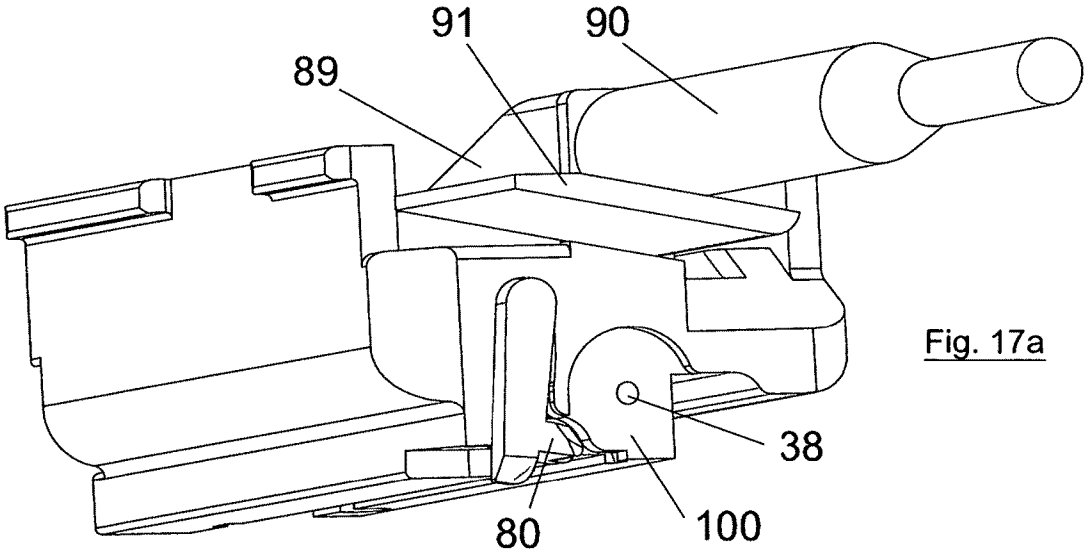
Figure 17D:
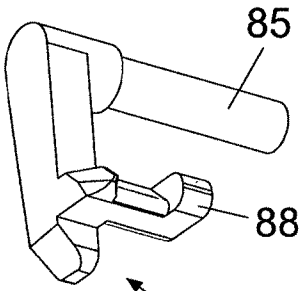
FIG. 17*d* shows the extractor.

In the description the terms right, left, front and rear will be used exactly as seen by the user of the weapon when he holds it.

With reference to the illustrated figures the submachine gun 1 is made up of a stock 2, a grip 3 provided with an extractable butt 20, a fixed barrel 4, a hammer 22 swinging in opposition and through the action of a spring actuator element 23 between a cocked position and an uncocked position, a trigger assembly 5 for the hammer 22 comprising a trigger 21 suitable for activating a kinematic chain for releasing the hammer 22, a bolt 6 sliding in a direction parallel to the longitudinal axis of the barrel 4 inside the stock 2 to close the breech of the barrel 4, a firing pin 37 for the ammunition actuatable by the hammer 22 and sliding in a direction parallel to the longitudinal axis of the barrel 4 in a seat 38 provided in the bolt 6, a system 7 for recovering the recoil kinetic energy of the bolt 6, an extractable magazine 8 for loading cartridge ammunition into a cartridge chamber 210 of the barrel 4, a flame-extinguishing cylindrical element 9, a front sleeve 10, a sight 11, and a cocking mechanism 12.

The stock 2 extends according to a longitudinal axis and the barrel 4 extends from its front end and is oriented with its longitudinal axis parallel to the longitudinal axis of the stock 2.

The grip 3 is positioned below the stock 2 and has a first portion 3*a* for coupling to the stock 2 which extends according to a longitudinal axis parallel to the longitudinal axis of the stock 2 and a second portion 3*b* defining the grip properly speaking, which extends according to a longitudinal axis transverse to the longitudinal axis of extension of the first portion 3*a*.

The second portion 3*b* is characterized by its pronounced inclination, which enables the user to shoot with his wrist turned forward and therefore to facilitate opposing the barrel bounce of the weapon.

More precisely, the barrel 4 is screwed into an internally threaded cylindrical seat 14 fashioned in a lower front appendage 15 of the stock 2.

The stock 2, having roughly the shape of a parallelepiped, with an upside-down "U" shaped cross section, contains inside it the trigger assembly 5, as well as the system 7 for recovering the kinetic energy of the bolt 6.

In order to render the motion of the bolt 6 safe and regular, a pair of guides (not shown) for the sliding of the bolt 6 has been provided on the side walls of the stock 2, on the inside.

The upper face of the stock 2 has threaded holes 17 for fastening, by means of screws, a shaped plate 18 having a dual function as a sight notch (endowed with fibre optic references at the sides of its window) and as a base for fastening all the accessories with Weaver style rail mounts or ones complying with American military standard MIL-STD 1913 (commonly known as Picatinny rails).

In the stock 2, in a rearward position relative to the cylindrical seat 14 the barrel 4 is screwed into, there is a ramp 19 for feeding the cartridge, situated slightly laterally offset relative to the longitudinal axis of the barrel 4. This choice, wholly unusual compared to the well-established tradition of forming, in portable automatic weapons, a feed ramp that is perfectly on an axis with the barrel, was motivated by the need to make it possible to feed cartridges with the particular magazine that will described below.

The lower front appendage 15 of the stock 2 further provides a base for fastening the trigger 21 and the pair of ambidextrous levers 250, which, as we will see, control the locking lever 251 of the bolt 6.

The stock 2 is joined to the grip 3 by means of two through pins 13*a*, 13*b*. The first pin 13*a* is set in a hole 13*a*' in the upper rear part of the weapon and also serves as a point of attachment for a carrying strap; the user can manually remove this pin 13*a* from its seat and proceed to disassemble the weapon, by overcoming a spring-operated retaining mechanism. Given the presence of the attachment for the strap, which has a ring shape, this pin 13*a* is asymmetrical and the user can decide whether to insert it in the weapon from the right side or the left one; presumably, a right-handed user will insert this pin 13*a* with the attachment for the strap on the left side of the weapon, and a left-handed person will do the opposite.

The second pin 13*b* is set in a hole 13*b*' and passes through the stock 2 in the aforesaid lower front appendage 15.

The pair of ambidextrous levers 250 which control the locking lever 251 of the bolt 6 rotate about the second pin 13*b*. In accordance with a logical sequence of disassembly of the weapon, it is not possible to remove this second pin 13*b* without first removing the front sleeve 10 which encircles the barrel 4, which will be discussed below.

The trigger assembly 5 for the hammer 22, of an extractable type, is contained in its own frame 40, fixed inside the stock 2.

The rotation pin 39 of the hammer 22 is fixed to the frame 40.

The trigger assembly 5 for the hammer 22 comprises the swinging trigger 21 pivoted by means of the pin 24 to the stock 2 and by means of the pin 25 to a sear lever 26, a pin 27 fixed to the frame 40 and acting as a support pin in rotation for a first opposing lever of the hammer 22 for single shot fire 28, for a second opposing lever of the hammer 22 for continuous burst fire 29, and for a third opposing lever 30 of the hammer 22 to prevent premature discharge.

The opposing levers 28, 29 and 30 of the hammer 22 in particular have one end 57, 58 and 59 respectively engageable against a protuberance 55 fashioned on the hammer 22 in a cylindrical portion 56 of the hammer 22 where the seat for the rotation pin 39 of the hammer 22 is provided. The first opposing lever of the hammer 22 for single shot fire 28 is actuatable by the sear lever 26, the second opposing lever of the hammer 22 for continuous burst fire 29 is likewise actuatable by the sear lever 26, whilst the third opposing lever 30 of the hammer 22 for preventing premature discharge is actuatable by the bolt 6 upon attaining its closed position.

Each opposing lever 28, 29, 30 is actuatable in opposition and through the action of a corresponding spring 31, 32, 33.

The rotation pins 24, 25, the pin 27, and the pivot pin 39 of the hammer 22 are parallel to one another and perpendicular to the plane in which the weapon mainly lies, formed by the longitudinal axes of the first and second portion 3*a*, 3*b* of the grip 3.

The horizontal sear lever 26 has its rear end coupled, by means of two appendages 45, 46 fashioned thereupon, to special formations 47, 48 fashioned on the levers opposing the hammer for single shot fire 28 and continuous burst fire 29, respectively.

A helical spring 49 housed in a cylindrical seat 76 positioned in the front part of the stock 2 is provided for the return of the trigger 21 into a rest position.

A manual fire mode selector 34 is connected to a rotating shaft 35 having a cam means 36 interacting with the opposing lever of the hammer 22 for single shot fire 28 and with the opposing lever of the hammer 22 for burst fire 29.

The shaft 35 is supported by the frame 40 rotatably about its own axis and is likewise oriented parallel to the rotation pins 24, 25, to the pin 27, and to the pivot pin 39 of the hammer 22.

The pin 27 also supports in rotation a manual anti-extraction lever 300 for preventing extraction of the shaft 35 from the frame 40.

The anti-extraction lever 300 is movable in opposition and through the action of a spring 301 so as to bring a tooth 308 thereof from a position of engagement to a position of disengagement from a groove 302 of the shaft 35.

The frame 40 has a side support portion 303 for the springs 31, 32, 33, 301 removably positioned in a retaining seat 304 for a plate 305 having through holes for guiding the springs 31, 32, 33, 301. The side portion 303 is provided with a spring system 306 for locking and releasing its position in the seat 304.

Removal of the side portion 303 is necessary in order to mount the springs 31, 32, 33, 301.

The manual selector 34 is switchable between a safety position, a position of enabling single shot fire, and a position of enabling burst fire.

The manual selector 34 is provided with a snap-lock system 307 for locking it into its working positions.

The system 307 comprises a pin 309, which rotates integrally with the manual selector 34 and is movable in opposition and through the action of a spring 310 along a wall 311 fixed externally to the frame 40 and provided with snap-fit holes 312 for the pin 309.

By way of example, when the manual selector 34 is in a horizontal position, the weapon is in a safety condition; if it is rotated downward by 45°, the weapon is set for single shot firing, whereas if it is rotated completely downward by 90°, the weapon is set for automatic continuous burst fire.

In the position of the manual selector 34 in which the weapon is in the safety condition, the cam means 36 blocks the opposing lever of the hammer 22 for burst fire 29, thus preventing the pull of the trigger 21.

In the position of the manual selector 34 in which the weapon is in the single shot firing condition, the cam means 36 does not interfere with the rotation of the levers opposing the hammer 22 for single shot fire 28 and for burst fire 29, thus enabling the pull of the trigger 21. The weapon comprises a system for disconnecting the trigger assembly 5 for single shot fire. On the horizontal sear lever 26, at about half its length in the lower part, there is a cam 50. During its retrograde motion caused by the shot, part of the bolt 6 enters into contact with said cam 50, causing the horizontal sear lever 26 to rotate slightly upward: this causes the detachment of the appendage 45 from the formation 47 and hence the disengagement of the rear end of the horizontal sear lever 26 from the opposing lever of the hammer for single shot fire 28. The horizontal sear lever 26 rises in opposition to a spring 77 which, when the user releases the trigger 21, lowers the horizontal sear lever 26 again by means of a pusher 390 and the lever 26 re-engages with the opposing lever of the hammer for single shot fire 28.

In the position of the manual selector 34 in which the weapon is in the burst fire condition, the cam means 36 moves the opposing lever of the hammer 22 for single shot fire 28, disengaging it from the hammer 22.

The trigger 21 comprises within it an automatic safety mechanism conceived to prevent accidental discharges due to pressing, presumably involuntary, on the sides of the trigger itself (the typical case is friction against the trigger when the weapon is introduced into a holster). A lever 51 pivoted with a pin 53 to the trigger 21 is provided at the centre of the trigger 21. During the user's normal shooting action, the lever 51 is pressed; this enables the trigger 21 to complete its full rotation and, therefore, to start the kinematic chain of the release until firing. In contrast, if the pressing of the trigger 21 is not accompanied by simultaneous pressing said lever 51, the upper end 52 of the lever 51 will impact against the stock 2 and prevent the trigger 21 from rotating; the action of undue firing is thus inhibited.

One of the salient features of the weapon consists in the fact that, contrary to convention, the rotation pin 39 of the hammer 22 is positioned in the upper parte thereof and, again contrary to what is normally encountered in other portable firearms, strikes the tail of the firing pin 37 with a rotational motion that goes from up to down.

The kinetic thrust of the hammer 22 is given by the spring actuator element 23, comprising for example a helical spring 313 housed in its own cylindrical case 314 pivoted with a pin 43 to the frame 40, and which transmits the accumulated force through a shaft 41, whose cylindrical end works in a specific seat 42 fashioned in the rear part of the hammer 22.

The hammer 22 has the rotation pin 39 positioned above the longitudinal axis of the barrel 4, a point of impact 200 with the firing pin 37 situated below its rotation pin 39 on the extension of the axis of the barrel 4, and a point of impact 201 with the bolt 6 situated below its rotation pin 39 and above the point of impact 200 with the firing pin 37, at a distance D1 from the longitudinal axis of the barrel 4.

The centre of mass G of the hammer 22 is in turn situated below the point of impact 201 with the bolt 6.

Preferably, the position of the centre of mass G of the hammer 22 is substantially on the extension of the axis of the barrel 4.

The hammer 22 is characterized in particular by its considerable size and mass.

Since the weapon operates with blowback action, the shot is opposed by the inertia of the mass of the bolt 6, to which we must add the mass of the hammer 22 multiplied by a factor of inertial increase.

Said factor of inertial increase arises from the fact that the hammer 22 moves together with the bolt 6, pushed by the bolt 6 itself; the push, and hence the force, is close to its centre of rotation and far from the centre of mass (barycentre) of the same, thus increasing the angular velocity.

Figure 18A:
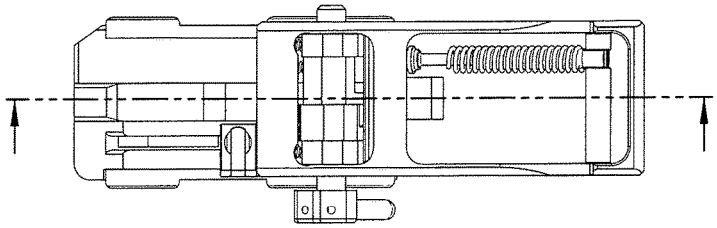
FIG. 18*a* shows the trigger assembly and FIGS. 18*b*, 18*c* show the trigger assembly in a sectional view along the line E-E of FIG. 18*a* in two operating positions which show the inertial increase in the mass of the hammer.
Figure 18B:
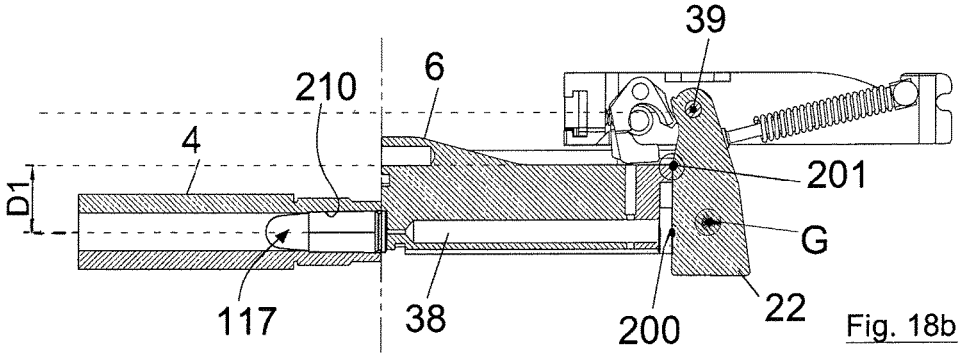
Figure 18C:
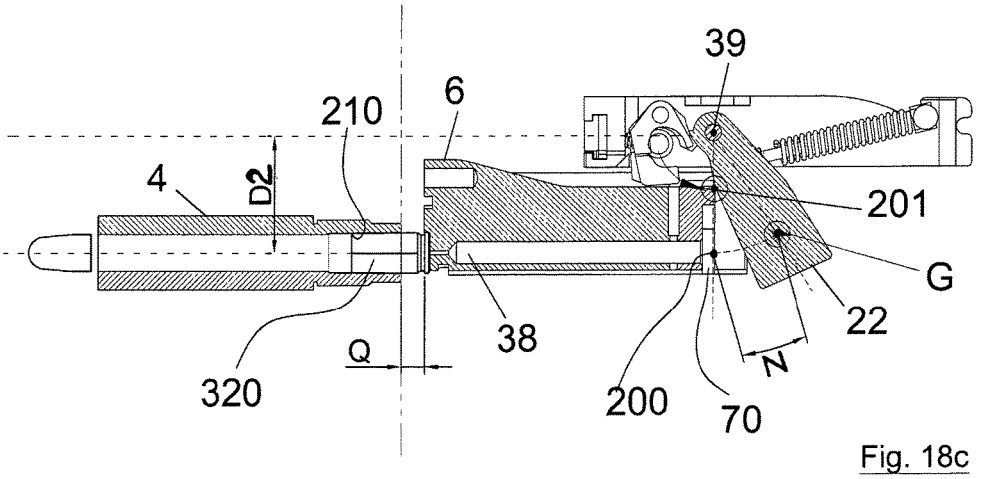
Figure 19A:
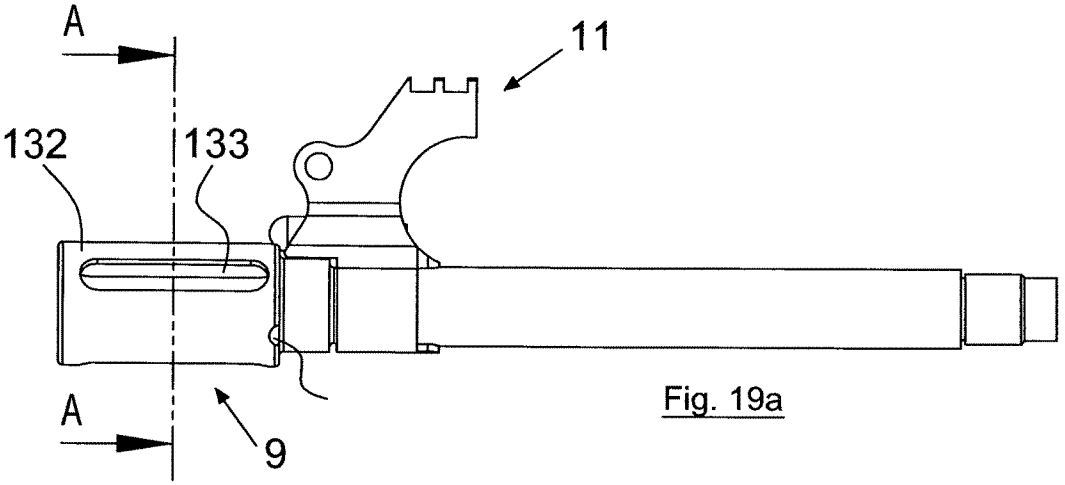
FIG. 19*a* shows a first version of the flame-extinguishing element and FIG. 19*b* a sectional view of the flame-extinguishing element along the line A-A of FIG. 19*a;*
Figure 19B:
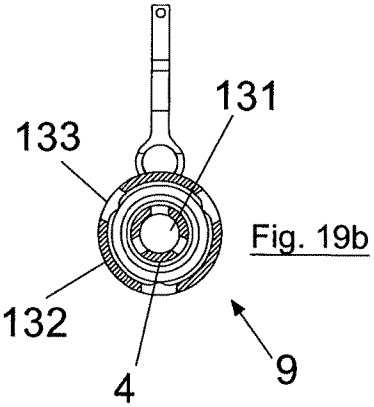
Figure 20A:
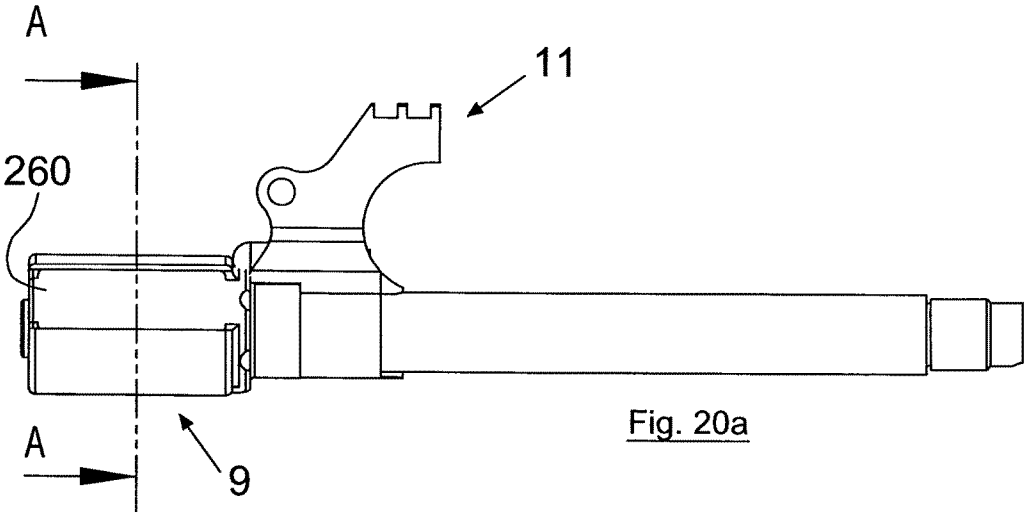
FIG. 20*a* shows a first version of the flame-extinguishing element and FIG. 20*b* a sectional view of the flame-extinguishing element along the line A-A of FIG. 20*a*.
Figure 20B:
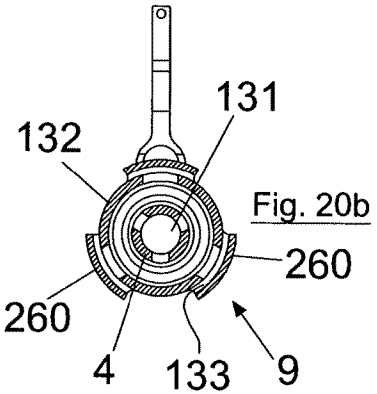

With reference to FIG. 18*c*, the factor "Fii" of inertial increase of the mass of the hammer 22, greater than one, is given by the ratio between the length N of the arc of circumference travelled by the centre of mass G as a result of the retrograde motion of length Q of the bolt 6, and the length Q itself.

This simple solution enables a considerable reduction in the mass of the bolt 6, which is necessary to ensure the safe operation of the weapon and re-vectorization of part of the energy (that contained in the hammer 22), which with its angular motion discharges upward, contributing to stabilizing the weapon during firing.

The remaining part of energy of the bolt is "blown back", as conventionally occurs, but with an evident reduction in linear stress compared to conventional blowback-operated weapons. The very reduction in the weight of the bolt thus obtained further contributes to stabilization, given the reduction in the moving masses (swinging masses).

Moreover, the large mass of the hammer 22 makes it possible, by simply replacing the spring actuator element 23, to adjust the burst fire rate within a certain range, though always ensuring adequate percussion.

The bolt 6 is slidingly supported inside the stock 2 along a pair of sliding guides which are interrupted for a portion about halfway along the length of the bolt 6 to enable the correct insertion thereof inside the stock 2.

Having vaguely the shape of a parallelepiped, the bolt 6 has in its rear part, toward the sides, two cylindrical longitudinal seats 61 housing within them an equal number of helical springs 62 which form the kinetic energy recovery system 7 of the bolt 6.

The two springs 62 are twin and constrained at their rear end to a rectangular plate 92.

The plate 92 firmly retains and guides the springs 62; however, it does not prevent the springs 62 themselves from bending in a longitudinal direction: this enables them to be easily inserted into their cylindrical seats 61.

The plate 92 is in contact with a second plate 93 made of a deformable elastic material which the bolt 6 comes up against at the end of its retrograde motion.

The plate 93 has the function of dampening the stroke of the bolt 6.

The kinetic energy recovery system 7 of the bolt 6 is housed in part in the bolt 6 (that is, the springs 62), whereas the plate 92 is snap fitted into the rear part of the stock 2 by means of two cylindrical pegs 94, which are inserted into an equal number of corresponding holes fashioned in the stock 2 itself.

It is relevant to note that, for ordinary disassembly purposes, the kinetic energy recovery system 7 of the bolt 6, despite being made up of several parts, forms a single piece.

In the rear part of the bolt 6, in the centre, there is also a vertical slot 63, which the hammer 22 enters into in the final phase of its rotation, when it transmits the kinetic impulse to the tail of the firing pin 37. In the centre of said slot 63, at the bottom, a seat 38 is provided for the firing pin 37: a through hole which extends on different levels. Analogously, the firing pin 37 has a cylindrical shape which extends on three levels; its helical opposing spring 69 is fitted over it. The firing pin 37 is held in its seat by a plate 70 sliding in a vertical direction inside a receptacle fashioned in the rear slot 63 of the bolt 6.

The horizontal sear lever 26 slides inside the bolt 6, in a groove 71 in a protected position.

The weapon is provided with a mechanism for automatically locking the firing pin 37 when the trigger 21 is not pressed, comprising a peg 72 sliding transversely to the direction of movement of the firing pin 37 in a seat 73 fashioned in the bolt 6.

The peg 72 slides through the action of the opposing lever of the hammer for burst fire 29 and in opposition to a spring 74 between a position of interference with the firing pin 37 and a position of non-interference with the firing pin 37.

In particular, with the trigger 21 in a rest position, the opposing lever of the hammer 22 for burst fire 29 (which is always solidly joined with the trigger 21) is disengaged from the peg 72, which is pushed upward by the spring 74 housed in the lower part of the seat 73. When it is in this higher position, the peg 72 is inserted into a snap-fit seat 75 fashioned in the firing pin 37: this prevents axial sliding of the firing pin 37 itself. On the other hand, when the peg 72 is in the lower position, it does not in any way engage the firing pin 37, which is thus free to slide; said condition occurs when the trigger 21 is kept pressed: when the trigger 21 is pulled, in fact, the horizontal sear lever 26 is activated and in turn rotates the opposing lever 29 until causing it to engage with the peg 72, which, on being pushed into a lower position, is freed from the snap-fit seat 75.

An extractor 81 for extracting the cartridge case 320 from the cartridge chamber of the barrel 4 is mounted on the bolt 6.

The extractor 81 has a catch 80 for holding the cartridge case head positioned in front of the head of the bolt 6.

The catch 80 is suitable for engaging with the perimeter groove normally provided on the case.

The catch 80 is movable between a position of retaining and a position of releasing the cartridge case head in opposition and through the action of a spring (not shown).

The conception of the extractor 81 is wholly original: the visible part thereof vaguely has the shape of an "L", whose shorter part, positioned below when the extractor 81 is mounted on the bolt 6, forms the catch 80. During the phase of feeding the cartridge into the cartridge chamber 210 of the barrel 4, the catch 80 of the extractor 81 enables the cartridge case head to rise until being completely seated in the head 100 of the bolt 6; at this point the catch 80 of the extractor 81 holds the cartridge itself in place by acting on the perimeter groove normally present on its case. To render possible the movement of the catch 80 of the extractor 81—first to receive the case head and then to hold it—the longest part of the extractor, situated at the top in a nearly upright position, can rotate within a narrow angle (but sufficient to carry out the previously described functions) by virtue of the fact that solidly joined to it at its upper end there is a shaft 85 acting as a rotation pin housed inside a cylindrical seat 86 fashioned on the front part of the bolt 6. The spring is wound around the shaft 85 and its front end is hooked onto the extractor 81.

The action of this spring operates the catch 80 of the extractor 81.

The extractor 81 also has a protrusion 88 engaged in a seat fashioned in the bolt 6 to prevent the shaft 85 from slipping out of its cylindrical seat 86.

The advantages deriving from the construction of the extractor 81 are its great simplicity, given that the extractor is made in one piece, and the possibility of replacing it rapidly, without the need for any tools.

The head 100 of the bolt 6 is slightly recessed on the front face of the bolt 6 in order to envelop the cartridge case head present in the cartridge chamber of the barrel 4.

At the centre of the head 100 of the bolt 6 there is the end of the seat 38 from which the firing pin 37 slides out.

Laterally to the head 100, the bolt 6 has an indentation 82 necessary for the operation of an ejector 84 of the cartridge case extracted from the cartridge chamber 210 of the barrel 4. In particular, the indentation 82 permits the bolt 6 to slide freely without any hindrance from the ejector 84.

On the upper part of the bolt 6, finally, there is a longitudinally extending appendage 89, a sort of "hump", whose front part acts as a support for a shaft 90, which extends longitudinally in a direction parallel to the axis of the barrel 4, and a plate 91 with a rectangular shape.

The shaft 90 is part of the cocking mechanism of the bolt, which will be discussed below, whereas the plate 91, which is located above the head of the bolt 9, acts as a deflector for the discharged cases: it diverts them downward to prevent them from hitting anyone who may be standing next to the weapon.

The grip 3 of the weapon performs various functions: besides acting as a closure for the lower part of the stock 2 and a grip strictly speaking, it provides a seat 109 for the magazine 8, a fastening base for a system for releasing the magazine 8, a protective bridge 101 for the trigger 21, a seat for fastening the ejector 84 and a sliding support guide for the butt 20.

Fashioned inside the second portion 3*b* of the grip 3 there is a seat 109 for the magazine 8, which, as usually occurs, must be inserted therein and extracted through the opening 103 present in the lower part of the seat 109.

Located in the second portion 3*b* of the grip 3, at the rear point of attachment of the bridge 101 of the trigger 21, there is the release mechanism of the magazine 8, comprising a tooth 104, pushed by a spring 105, which is inserted into a specific seat 106 fashioned on a case 107 of the magazine 8 itself. To release said tooth 104, and thereby enable the extraction of the magazine 8, the user must act on a specific control lever 108 while maintaining his hold on the weapon.

The extraction guide of the butt 20 has a curved configuration, in particular bow-shaped, to assure the movement of the butt 20 between a position in which it is retracted inside the grip 3 and a position in which it is extracted from the grip 3 and lower than in the retracted position.

In particular, the butt 20 has a vaguely "U" shaped structure comprising two curved prongs 113 sliding inside the grip. Said architecture is particularly important for the purposes of the weapon's ergonomics, because when the butt 20 is housed inside the grip 3 it does not create additional bulk and does not cause disturbance to the user and, conversely, when the butt 20 is in the extended position, its use is the same as that of a conventional butt.

A retaining mechanism for the butt 20, as well as a butt plate 114, are applied to the part of the structure of the butt 20 which joins the two prongs 113. The aforesaid retaining mechanism for the butt 20 automatically locks it inside its seat in the grip 3: to extract the butt 20 it is necessary to act on a specific lever 115 situated on the lower part of the weapon. Analogously, also when the butt 20 is in a completely extended position, the user must press said lever 115 in order to make it go back into its seat.

The weapon is fed by an extractable prismatic magazine 8, of the two-row type with individual exposure of the cartridge, which differs from every preceding design because of the asymmetrical placement of the lips 118, 119. The first cartridge 117 present therein is offset relative to the median longitudinal axis 120 of the magazine 8 itself; this means that the lips of the magazine 118, 119, which have the task of holding the cartridges inside them and of guiding the first of them toward the breech of the barrel 4 during feeding, are at different heights. This particular architecture is motivated by the desire to solve the well-known problem that regards conventional loaders of the type presenting cartridges individually: in fact, a slight deformation of their lips is sufficient to prevent them from functioning correctly. It may occur, in fact, that the capacity of the lips to retain the first cartridge is weakened until becoming insufficient and causing the weapon to jam.

The magazine 8, on the other hand, exploits the geometry of the lips 118, 119 to obtain a more reliable retention of the ammunition contained therein, comparable to that provided by two-row loaders with alternating presentation of the cartridges, but with more compact dimensions. The particular geometry of the magazine 8, in fact, enables a different arrangement of the forces inside it, with less stress on the lips 118, 119, which can correctly perform their function even in the event of substantial deformations.

The magazine 8 has a floor plate 124 for lifting the cartridge and a helical spring 121 which acts on it by pushing it upward; both are contained in the prismatic case 122, which is closed off on the bottom by a base 123, fixed to the case 122.

The weapon has a device for automatically locking the bolt 6 in the open position after the last ammunition present in the magazine 8 has been discharged, and a manual actuating lever 122 for releasing the bolt 6.

The device 123 for automatically locking the bolt 6 comprises a locking lever 251 pivoted with a pin 125 in a hole 252 on the lower front appendage 15 of the stock 2.

The locking lever 251 has a first appendage 253 for taking up the movement from the lifting floor plate 124 and, on the side opposite the first appendage 253 relative to the pin 125, and second appendage 254 for taking up the movement from the release lever 250, and in particular from a tooth 255 fashioned on the release lever 250.

After the explosion of the last cartridge 117 contained in the magazine 8, the lifting floor plate 124, on reaching the highest position possible as a result of the thrust of the spring 121, enters into contact with the appendage 253 fashioned on the locking lever 251 of the bolt 6 and pushes it upward. The locking lever 251, when it rotates through the action of the lifting floor plate 124, comes to lock the bolt 6 into its rearward position.

When the user acts on the release lever 250, the rotation thereof as a result of the engagement of the tooth 255 with the appendage 254 brings about a rotation contrary to the previous one, thanks to which the bolt 6 is released from the locking lever 251 and, as a result of the expansion of the two recovery springs 62, returns immediately into the closed position.

The barrel 4 is characterized by its cylindrical outer profile. As seen, in the breech portion the barrel 4 has, for a short length, a thread used to fasten it to the stock 2 of the weapon.

A transverse locking pin 130 prevents accidental unscrewing of the barrel 4.

Screwed onto the muzzle of the barrel 4, where first slots 131 passing through the thickness of the wall of the barrel 4 are present, there is at least one flame-extinguishing cylindrical element 132 comprising second slots 133 passing through the thickness of the wall of the cylindrical element 132 offset from the first slots 131.

In particular, the barrel 4 has three first longitudinal slots 131, spaced apart by 120°, just as the cylindrical element 132 has three second longitudinal slots 133 spaced apart by 120° and offset by 60° relative to the first slots 131.

The barrel/flame-extinguishing element thus formed attenuates all flashes produced by the combustion of the propellant charge of the ammunition.

A second type of flame-extinguishing cylindrical element, of slightly larger dimensions, and capable of also attenuating any indirect light that should come to be created inside it, is also envisaged. The difference consists in that the second slots are covered with further sectors of the cylindrical wall 260, suitably spaced apart, which enables the gases to expand radially.

On the barrel 4, between the flame-extinguishing cylindrical element 132 and an outer shoulder 134 of the barrel 4, there is fitted a bushing-shaped support 135 for a sight 136.

The support 135 has at least one anti-rotation abutting element 180 engageable in a corresponding seat 137 fashioned on the barrel 4. Preferably, two anti-rotation abutting elements 180 are provided in a diametrically opposed position on the support 135.

The support 135 supports a locking peg 138 for preventing the flame-extinguishing cylindrical element 132 from coming unscrewed.

The peg 138 slides in opposition and through the action of a spring 139 in a bushing-shaped guide 140 having a longitudinal axis parallel to the axis of the barrel 4.

The guide 140 is interposed between the sight 136 and the support 135.

The guide 140, the sight 136 and the support 135 are made in one piece.

The peg 138 is configured and disposed so as to be inserted in a corresponding seat 141 fashioned on the flame-extinguishing cylindrical element 132.

In particular, to enable the flame-extinguishing cylindrical element 132 to be screwed on for the necessary length, the flame-extinguishing cylindrical element 132 has a number of perimeter seats 141 selectively engageable by the peg 138.

Since through the action of the spring 139 the peg 138 is inserted in a corresponding seat 141, the rotation of the flame-extinguishing cylindrical element 132 is inhibited. In order to unscrew the flame-extinguishing cylindrical element 132 it is thus necessary to move back the peg 138, even only with one's fingers, until it disengages from the seat 141 in which it is inserted.

In the sight 136 properly speaking, an optic fibre is mounted. In order to correctly collimate the weapon, the user exploits the profile of the sight 136, made more visible and more easily acquirable thanks to the presence of the optic fibre.

The weapon has, as said, a removable sleeve 10 on the front which encircles the barrel 4 and the front part of the stock 2 and of the grip 3.

The sleeve 10 houses within it a device for manually cocking the hammer 22, comprising a swinging cocking handle 143 pivoted with a pin 144 to a support 145 translatable along a linear guide 146 parallel to the longitudinal axis of the barrel 4.

The linear guide 146 consists, in particular, of a cross member fixed to the front part of the stock 2.

The handle 143 is configured and disposed so as to engage the bolt 6, and in particular the head of the shaft 90 fixed to the bolt 6, in a point radially distanced from the pin 144.

During shooting, the cocking handle 143 remains stationary inside its housing; to use it, it is necessary to rotate it so that it comes out from the side of the weapon.

The initial rotation of the cocking handle 143 exploits a lever arm which enables the greater initial resistance opposed by the hammer 22 to be easily overcome (obviously when the latter is in the uncocked position). Therefore, the retrograde movement of the cocking handle 143, as a result of the pull exerted on it by the user, is transformed into a linear motion which accompanies the bolt 6 into its most rearward position.

The front sleeve 142 also performs other functions.

With the aim of increasing the weapon's versatility of use to a maximum, a supplementary front grip 147 is provided for the so-called "weak hand" (the left one in the case of right-handed users, the right one in the case of left-handed users). Said supplementary front grip 147 can be used both with the butt 20 in a closed position—that is, when the weapon is held like a normal pistol—and with the butt 20 in the extended position—that is, when the weapon is held like a normal carbine. In order to use the supplementary front grip 147, it is necessary to turn it downward and forward by about 90°, until reaching the automatic locking position. A spring-operated locking mechanism (not shown), fashioned on the pin 148 about which the grip rotates, serves, in fact, to lock it firmly in the open position. To bring the supplementary front grip 147 back into the closed position, it is necessary to press on the pin 148 thereof from one side of the weapon in order to deactivate the spring-operated locking mechanism. In the closed position, the outer profile of the grip is harmonized with the silhouette of the weapon; when closed, the supplementary front grip 147 can be used to grasp the weapon like a normal rod of a carbine.

On the sides of the front sleeve 10 there are threaded holes for fastening, by means of screws, an equal number of shaped plates 149, 150 having the function of a base for fastening all the accessories with Weaver style rail mounts or ones complying with American military standard MIL-STD 1913 (commonly known as Picatinny rails).

The front sleeve 10 must be removed in order to be able to access and extract the through pin which constrains the stock 2 and the grip 3 to each other.

Generally speaking, the use of the weapon takes place according to the methods commonly known among the users of said tools, notwithstanding the different procedures deriving from the particular features of the weapon itself. Intrinsically, the weapon offers maximum assurances of safety (automatic mechanism which prevents premature discharge when the bolt is not completely closed, automatic mechanism which automatically locks the firing pin when the trigger is not pressed and automatic mechanism which prevents the trigger from being pulled back involuntarily).

Also when the weapon is handled by the user, a maximum degree of safety is always offered, thanks to its particular conception. In fact, the manual safety control has been conceived in such a way as to prevent the hammer from being cocked (and thus prevent use of the weapon) when the control lever is in a horizontal (safety) position. To load the weapon correctly in conditions of safety, the user—after ascertaining that the weapon is discharged according to the universally known and applied standard procedures—must:

put the fire mode selector 34 in the single shot position;

pull the cocking handle 143 back completely;

put the fire mode selector 34 in the safety position;

insert a magazine 8 with ammunition in the seat provided until it is engaged.

At this point, with the fire mode selector 34 in the safety position, it is possible pull the cocking handle 143 back all the way and release it so as to insert a cartridge 117 into the cartridge chamber of the barrel 4. It should thus be noted that the actual operation of loading the weapon takes place with the fire mode selector in the safety position. In order to fire, the user needs only lower the fire mode selector 34 into the preferred position (single shot or continuous burst fire) and press the trigger 21.

After completing the shot, it is sufficient to move the fire mode selector 34 back into the safety position (horizontal).

Unloading of the weapon also takes place in conditions of safety, because with one shot still present in the cartridge chamber of the barrel 4 and the magazine 8 containing the cartridges 117, it is sufficient:

to move the fire mode selector 34 into the safety position;

to extract the magazine 8 with the ammunition from its seat after actuating the release control; and to pull the cocking handle 143 all the way back to eject the cartridge present in the cartridge chamber of the barrel 4.

The weapon thus conceived is susceptible of numerous modifications and variants, all falling within the scope of the inventive concept; moreover, all the details may be replaced with technically equivalent elements.

The materials used, as well as the dimensions, may in practice be of any type according to requirements and the state of the art.

The invention claimed is:

1. An automatic submachine gun for exploiting recoil, comprising:

a stock (2);

a fixed barrel (4);

a grip (3) provided with an extractable butt (20);

a bolt (6) configured to slide in a direction parallel to a longitudinal axis of the barrel (4), inside the stock (2), to lock a breech of the barrel (4);

a device for recovering recoil kinetic energy of the bolt (6);

a hammer (22) configured to swing in opposition to, and through action of, a spring actuator element (23), the hammer configured to swing between a cocked position and an uncocked position;

a trigger assembly for the hammer (22) comprising: in turn a swinging trigger (21) pivoted on the stock (2) and operatively connected to a sear lever (26); a first opposing lever (28) of the hammer (22) for single shot fire actuatable by the sear lever (26); and a second opposing lever (29) of the hammer (22) for continuous burst fire actuatable by the sear lever (26);

a manual fire mode selector (34) connected to a rotating shaft (35) having a cam (36) configured to interact with said first opposing lever (28) of the hammer for single shot fire and with said second opposing lever (29) of the hammer for burst fire;

an extractable magazine (8) for loading cartridge ammunition into a cartridge chamber (210) of the barrel (4); and a firing pin (37) actuatable by the hammer (22) and configured to slide in a direction parallel to the longitudinal axis of the barrel (4) in a seat provided in the bolt (6);

where the hammer (22) is configured and disposed to interact with the bolt (6) to absorb a significant fraction of the recoil kinetic energy of the bolt (6) for attainment of the cocked position;

where the hammer (22) has a point of impact (201) with the bolt (6), where a centre of mass (G) of the hammer (22) is positioned below the point of impact (201) of the hammer (22) with the bolt (6), and where, upon interaction of the hammer (22) with the bolt (6), a length of movement of the centre of mass (G) of the hammer (22) is amplified relative to a length of movement of the bolt (6); and where the gun is blowback operated, and where the breech of the barrel is not locked mechanically at time of firing.

2. The submachine gun according to claim 1, wherein the hammer (22) has a rotation pin (39) positioned above the longitudinal axis of the barrel (4).

3. The submachine gun according to claim 2, wherein the hammer (22) has a point of impact (200) with the firing pin (37) situated below said rotation pin (39).

4. The submachine gun according to claim 3, wherein the point of impact (201) of the hammer (22) with the bolt (6) is situated below said rotation pin (39) and above said point of impact (200) of the hammer (22) with the firing pin (37).

5. The submachine gun according to claim 1, wherein the trigger assembly for the hammer further comprises a third opposing lever (30) of the hammer (22) for preventing a premature discharge actuatable by the bolt (6) on attaining a locked position.

6. The submachine gun according to claim 1, wherein said manual fire mode selector (34) is solidly joined in rotation with said rotating shaft (35) and is rotatable into: a first angular position, where the cam (36) blocks at least one of the first and the second levers (28, 29) opposing the hammer (22) for single shot fire and for burst fire; a second angular position, where the cam (36) does not interfere with the first and the second levers (28, 29) opposing the hammer (22) for single shot fire and for burst fire; and a third angular position, where the cam (36) disengages the first opposing lever (28) of the hammer for single shot fire from the hammer (22).

7. The submachine gun according to claim 1, wherein, for single shot fire, said sear lever (26) has a lever cam (50) engageable by the bolt (6) to rotate the sear lever (26) into a position of disconnection from the first opposing lever (28) of the hammer for single shot fire when the trigger (21) is pressed.

8. The submachine gun according to claim 1, wherein said magazine (8), of the two-row type with individual exposure of a cartridge, has an asymmetrical placement of retaining lips (118, 119) for a first cartridge, to place the first cartridge in an offset position relative to a median longitudinal axis (120) of the magazine (8).

9. The submachine gun according to claim 1, wherein the stock (2) has a ramp (19) for feeding cartridge ammunition into the breach of the barrel (4), where the breech of the barrel (4) is laterally offset relative to the longitudinal axis of the barrel (4).

10. The submachine gun according to claim 1, wherein said extractable butt (20) is configured to slide along a curved guide (112) between a retracted position and an extracted position, where the extracted position is lower than the retracted position.

11. The submachine gun according to claim 1, further comprising a device for automatically locking the firing pin (37) when the trigger (21) is not pressed, the device comprising a peg (72) housed in a seat (73) fashioned in the bolt (6), said peg (72) being translatable transversely to the firing pin (37) through action of the second opposing lever (29) of the hammer in opposition to a spring between a position of interference with the firing pin (37) and a position of non-interference with the firing pin (37).

12. The submachine gun according to claim 1, further comprising at least one flame-extinguishing cylindrical element (132), screwed onto the muzzle of the barrel (4), where first slots (131) pass through a thickness of a wall of the barrel (4), the at least one flame-extinguishing cylindrical element (132) comprising second slots (133) passing through a thickness of a wall of the cylindrical element (132) and offset from the first slots (131).

13. The submachine gun according to claim 12, wherein, on said barrel (4), between said at least one flame-extinguishing cylindrical element (132) and an outer shoulder (134) of said barrel (4), there is fitted a bushing-shaped support (135) for a sight (136) having at least one anti-rotation abutting element (180) engageable in a corresponding seat (137) fashioned on the barrel (4), wherein said support (135) for said sight (136) supports a peg (138) for preventing the at least one flame-extinguishing cylindrical element (132) from coming unscrewed, said peg (138) sliding in opposition to and through action of, a spring, and being configured and disposed to be inserted in a corresponding seat (141) fashioned on the at least one flame-extinguishing cylindrical element (132).

* * * * *